US005883609A

United States Patent [19]

Asada et al.

[11] Patent Number: 5,883,609

[45] Date of Patent: Mar. 16, 1999

[54] ACTIVE MATRIX TYPE LIQUID CRYSTAL DISPLAY WITH MULTI-MEDIA ORIENTED DRIVERS AND DRIVING METHOD FOR SAME

[75] Inventors: Hideki Asada; Kazunori Ozawa; Hiroyuki Fukumori, all of Tokyo, Japan

[73] Assignee: NEC Corporation, Tokyo, Japan

[21] Appl. No.: 549,545

[22] Filed: Oct. 27, 1995

[30] Foreign Application Priority Data

Oct. 27, 1994 [JP] Japan ..... 6-263753
Oct. 27, 1994 [JP] Japan ..... 6-263754

[51] Int. Cl.[6] ..... G09G 3/36

[52] U.S. Cl. ..... 345/100

[58] Field of Search ..... 345/98, 100, 103

[56] References Cited

U.S. PATENT DOCUMENTS 4,803,480 2/1989 Soneda ..... 345/100
4,870,399 9/1989 Carlston ..... 345/100
5,166,671 11/1992 Maekawa ..... 345/100
5,250,931 10/1993 Misawa ..... 345/98
5,251,051 10/1993 Fujiyoshi ..... 345/100
5,355,023 10/1994 Edwards ..... 345/100
5,357,290 10/1994 Horibe ..... 345/100
5,602,561 2/1997 Kagawuchi et al. ..... 345/100
5,644,331 7/1997 Hazama ..... 345/100
5,654,659 8/1997 Hasada ..... 345/100

*Primary Examiner*—Mark K. Zimmerman
*Assistant Examiner*—Ronald Laneau
*Attorney, Agent, or Firm*—Foley & Lardner

[57] ABSTRACT

A vertical drive circuit comprises a shift circuit composed of a plurality of cascaded half-bit scan circuits, a plurality of NAND gate circuits controlled by output signals of the scan circuits and control signals, and a plurality of output buffer circuits connected to the NAND gate circuits. A horizontal drive circuit comprises a shift circuit composed of a plurality of cascaded half-bit scan circuits, a plurality of first NAND gate circuits controlled by output signals of the scan circuits and control signals, a plurality of second NAND gate circuits controlled by output signals of the first NAND gate circuits and enable signals, and a plurality of data sampling and holding circuits controlled by output signals of the second NAND gate circuits.

25 Claims, 24 Drawing Sheets

HORIZONTAL DRIVE CIRCUIT
103
12
17-1
VSTa
HALF BIT SCAN CCT
14-1
14-2
14-3
14-256
14-257
P-1
P-2
P-3
P-256
17
G-1
G-2
G-3
G-4
G-5
G-6
G-7
G-8
15-1
15-2
15-3
15-4
15-5
15-6
15-7
15-8
15-9
15-10
15-1021
15-1022
15-1023
15-1024
16-1
16-2
16-3
16-4
16-5
16-6
16-7
16-8
16-9
16-10
16-1021
16-1022
16-1023
16-1024
GP-1
GP-2
GP-3
GP-4
GP-5
GP-6
GP-7
GP-8
GP-9
GP-10
GP-1021
GP-1022
GP-1023
GP-1024
Px (i, j)
j
i
10
101
VSTb
17-2

ACTIVE MATRIX TYPE LIQUID CRYSTAL DISPLAY WITH MULTI-MEDIA ORIENTED DRIVERS AND DRIVING METHOD FOR SAME

BACKGROUND OF THE INVENTION

The present invention relates generally to a liquid crystal display (hereafter "LCD") and a driving method thereof, and particularly, to an active matrix type LCD with vertical and horizontal drivers operative in a multi-media network, e.g. adaptive to multiple scan modes such as in a large-sized or presentation-oriented display or projector (hereafter collectively "PROJECTOR") and a now or high-grade television or high-definition television (hereafter collectively "TV"), and to a driving method for the same.

DESCRIPTION OF THE RELATED ART

Toward a full-scale advent of a multi-media age, recent years have witnessed an increasing need for an LCD adaptive to various media, such as a personal computer, a work station and a variety of computing machines (hereafter collectively "COMPUTER"), a PROJECTOR and a TV, that may have their principal display specifications different from each other, such as in signal bandwidth, pixel number and scan modes.

Such an LCD is needed to be cooperative with various signal sources.

For example, to be adaptive to a typical COMPUTER, the LCD is needed to display a temporal sequence of single-field picture frames in response to a signal formatted for a non-interlacing scan mode in which a predetermined number of sequentially ordered scan lines are scanned sequentially, i.e. in an order thereof in each field, whether the order is odd number or even number.

On the other hand, to be adaptive to a PROJECTOR or TV, the LCD is needed to display a temporal sequence of double-field picture frames in response to a signal formatted for an interlacing scan mode in which a predetermined number of sequentially ordered scan lines are scanned in an interlacing manner so that in each odd-numbered field, odd number lines are sequentially scanned, and in each even-numbered field, even number lines are sequentially scanned.

In particular, to make up for some characteristics such as an afterimage characteristic peculiar to a liquid crystal, a typical LCD for a PROJECTOR or TV is needed to be implemented to perform a dual-line simultaneous scan in such a mode that in each odd-numbered field, when scanning an odd number line to write therein image data, a subsequent even number line is simultaneously scanned to write those data, and in each even-numbered field, when scanning an even number line to write therein image data, a subsequent odd number line is simultaneously scanned to write these data.

Moreover, for use in a multi-media network, it is desirable for an LCD with a predetermined number of matrix-arrayed pixels to be responsive to a picture signal formatted for a smaller number of pixels than the predetermined number, to display a picture expanded to a double in both vertical and horizontal directions.

For example, it may be advantageous and efficient for an LCD with 1,024 scan lines by 1,280 data lines to respond to a signal formatted for 480 scan lines by 640 data lines to display a picture, to expand the picture to a double in both vertical and horizontal directions so that 960 scan lines by 1,280 data lines of the LCD are employed to display the expanded picture.

It may be needed for such an LCD to respond to a formatted signal for 600 scan lines by 800 data lines, to expand a represented picture to a 1.6-fold in both vertical and horizontal directions so that 960 scan lines by 1,280 data lines of the LCD are employed to display the expanded picture.

A typical LCD comprises a liquid crystal display member or panel composed of a back-lighted transparent pixel layer consisting of a predetermined number of matrix-arrayed active pixels defining a square display area, the pixels being constituted with a matrix of thin-film transistors (hereafter "TFT") integrally formed on a glass or quartz substrate, and peripheral drive circuitry composed of a vertical driver for scanning respective gates of the TFTs and horizontal drivers for supplying or writing image data to the pixels to display a picture on the display area in accordance with a picture signal.

If the picture signal is formatted for a smaller number of pixels than the predetermined number, the display member displays an expanded or non-expanded picture in a corresponding square region (hereafter "picture region"), leaving therearound vertical and/or horizontal blank regions (hereafter collectively "blank region").

In a PROJECTOR or TV, such a blank region is displayed in a so-called "black" color so that one may well cherish an illusion that the blank region did not constitute a display area.

It therefore is needed for an LCD to be adaptive to writing data of a black color to pixels in a blank region thereof, during a blanking period.

Moreover, it is desirable for an LCD to displace an image region on a display area thereof in a flexible manner.

Further, in an application to a color PROJECTOR, a display member of an LCD is composed of three pixel layers, one for a red image, another for a green image and the other for a blue image. The three layers are laminated so that, among rays of light transmitted therethrough, those responsible for one of three primary colors are different from those for the others in numbers of refractions and reflections they are subjected to. It thus is needed for a color LCD to be adaptive to driving one of three pixel layers to display a picture in a mirror image. Furthermore, it is desirable for a single PROJECTOR to be flexibly adaptive to various manners of projection, e.g. a front projection, a rear projection and a tilted projection such as for a floor or ceiling arrangement.

Therefore, an LCD is needed to have vertical and horizontal drivers adaptive to a two-way scan mode.

Accordingly, toward an advent of a multi-media age, there is a strong potential need for a multi-media-oriented universal versatile LCD (hereafter "multi-purpose LCD") adaptive to a multi-scan mode, an expanding display, an image region displacement, a black data writing and a two-way scan, as described.

Under such circumstances, researches and developments have been trying to achieve a multi-purpose LCD in which peripheral drive circuitry of a TFT array is integrally formed on the same substrate as the TFT array to permit a reduced size and an improved cost effect.

In some conventional cases, the peripheral drive circuitry has a vertical driver and/or a horizontal driver thereof composed of a shift register circuit operative in a particular scan mode in response to a picture signal formatted for a particular number of pixels, by using no more than about three control signals.

However, in the conventional cases, the use of a shift register circuit impose an undesirable speed limit on actions of the circuitry and an undesirable frequency limit on a write operation so that it is difficult to write a black data in pixels of a blank region within a blanking period.

Therefore, in those cases it would be difficult to implement a practical multi-purpose LCD.

In some conventional cases, the peripheral drive circuitry has a vertical driver and/or a horizontal driver thereof composed of an address decoder.

FIG. 1 shows a circuit diagram of a conventional multi-purpose LCD with a vertical drive circuit composed of an address decoder, and FIG. 2 shows time charts of signals associated with a non-interlacing sequantial scan mode of the multi-purpose LCD. Signal lines and signals thereon are designated by common reference characters.

In FIG. 1, designated at reference character 100 is the conventional LCD. The LCD 100 comprises a liquid crystal display member 101 composed of a back-lighted transparent pixel layer consisting of 1,024×1,280 matrix-arrayed active pixels Px (i, j) cooperatively defining a square display area, and peripheral drive circuitry 102–103 including a vertical drive circuit 102 composed of an address decoder 104 connected to the pixels Px(i, j) via 1,024 parallel scan lines GP-1~GP-1024 and a horizontal drive circuit 103 connected to the pixels Px(i, j) via 1,280 parallel data lines.

Each pixel Px(i, j) is identifiable as a small square piece (hatched in the figure) located in a vicinity of a cross point Cr(i, j) between an i-th scan line and a j-th data line and defined by and between the i-th and an i+1-th scan line and the j-th and a j+1-th data line, or as a picture element located at a j-th column of an i-th row in a pixel matrix, where i and j are arbitrary integers such that $1 \leqq i \leqq 1{,}024$ and $1 \leqq j \leqq 1{,}280$.

Any pixel Px(i, j) comprises a switching TFT Tr(i, j) connected at a gate thereof to the i-th scan line and at a source or drain thereof to the j-th data line, a collective capacitor Ec(i, j) connected at either electrode thereof to the remaining electrode of the TFT Tr(i, j) and at the other electrode thereof to a grounded common electrode, and a volume of liquid crystal filled over the capacitor Ec(i, j) to have an optical anisotropy depending on an electric potential developed by a quantity of charges written to be stored as an image data in the capacitor Ec(i, j).

The address decoder 104 is provided with twenty input terminals 107-1~107-20 for receiving twenty vertical scan control signals AV-0, AV-0$^-$ (suffix "$^-$" means a negative logic level represented by an overhead bar in the figure), AV-1, AV-1 $^-$, . . . , AV-k (k is an arbitrary integer such that $0 \leqq k \leqq 9$), AV-k$^-$, . . . , AV-9 and AV-9$^-$.

As shown in FIG. 2, each control signal AV-k or AV-k$^-$ comprises a clock signal having a duration of $T \times 2^k$, where T is a duration of the control signal AV-0 or AV-0$^-$, so that the 1,024 ($=2^{10}=2\times2^9$) scan lines are arbitrarily selectable, individually or in combination, by a combination of logic levels of the control signals.

Therefore, the conventional LCD 100 is operative in the non-interlacing sequential scan mode shown in FIG. 2, as well as in an interlacing scan mode and a dual-line simultaneous scan mode.

Moreover, the conventional LCD 100 is adaptive to a picture expanding display, an image region displacement and a two-way scan mode.

Further, the conventional LCD 100 is adaptive to a simultaneous selection of scan lines GP-i connected to those pixels Px(i, j) needing a black color data to be written therein during a vertical blanking period, thus permitting a relatively long interval of time to be provided for the vertical black data writing.

Accordingly, the conventional LCD 100 is employable as a practical multi-purpose LCD.

FIG. 3 shows a circuit diagram of a conventional multi-purpose LCD with a horizontal drive circuit composed of an address decoder, and FIG. 4 shows time charts of signals associated with a sequential horizontal scan of the multi-purpose LCD. Like members or items to FIGS. 1 and 2 are designated at like reference characters in FIGS. 3 and 4. Signal lines and signals thereon are designated by common reference characters, unless otherwise specified.

In FIG. 3, designated at reference character 200 is the conventional LCD. The LCD 200 comprises a liquid crystal display member 101 composed of a back-lighted transparent pixel layer consisting of 1,024×1,280 matrix-arrayed active pixels Px (i, j) cooperatively defining a square display area, and peripheral drive circuitry 102–103.

The peripheral drive circuitry 102–103 includes a vertical drive circuit 102 connected to the pixels Px(i, j) via 1,024 parallel scan lines GP-1~GP-1024, and a horizontal drive circuit 103 connected to the pixels Px(i, j) via 1,280 (=16×80) parallel data supply lines DS-1~DS-1280.

The horizontal drive circuit 103 is composed of a horizontal scan circuit 204 constituted with an address decoder 205, sixteen parallel data bus lines 207-1~207-16 for supplying sixteen multi-phased image data S-1~S-16, respectively, and eighty parallel blocks of data sampling and holding (hereafter "SH") circuits.

Letting p and q be arbitrary integers such that $1 \leqq p \leqq 16$ and $1 \leqq q \leqq 80$, respectively, a q-th SH circuit block consists of 16 SH circuits of which a p-th one is connected at a data input end thereof to a p-th one 207-p of the 16 data bus lines 207-1~207-16 and at a data output end thereof to a p-th one DS-j (j=16q+p-16) of corresponding 16 data supply lines DS-(16q-15)~DS-16q.

A p-th SH circuit of a q-th circuit block is composed of an SH switch 208-j (j=16q+p-16) as an FET connected at a gate thereof to the address decoder 205, for receiving therefrom a q-th one SP-q of eighty parallel sampling pulses SP-1~SP-80 and at either of a source and a drain thereof to both the input and output ends of the SH circuit, and an SH capacitor 209-j (j=16q+p-16) connected between the data output end of the SH circuit and a grounded common electrode, for holding therein a data S-p sampled from a corresponding data bus line 207-p to be written in vertically scanned pixels Px(i, j) during an image writing period.

Each pixel Px(i, j) is identifiable as a small square piece (hatched in the figure) located in a vicinity of a cross point Cr(i, j) between an i-th scan line and a i-th data line, like the LCD 100 of FIG. 1.

The address decoder 204 is provided with fourteen input terminals 206-1~206-14 for receiving fourteen horizontal scan control signals AH-0, AH-0$^-$, AH-1, AH-1$^-$, . . . , AH-r (r is an arbitrary integer such that $0 \leqq r \leqq 6$), AH-r$^-$, . . . , AH-6 and AH-6$^-$.

As shown in FIG. 4, each control signal AH-r or AH-r$^-$ comprises a clock signal having a duration of $T \times 2^r$, where T is a duration of the control signal AH-0 or AH-0$^-$, so that the 80 (=between $2^6$ and $2^7$) SH circuit blocks are arbitrarily selectable, individually or in combination, by a combination of logic levels of the control signals. In FIG. 4, a sequential vertical scan is illustrated as a series of occurrences of an image data writing action represented by a scan end time $t_q$ ($=t_0+T\times q$).

Therefore, the conventional LCD 200 is operative in any mode that the vertical drive circuit 102 permits.

In particular, the conventional LCD 200 is adaptive to a simultaneous selection of all the 80 SH circuit blocks for a black data writing to upper and lower blank regions during a horizontal blanking period, thus permitting a relatively long interval of time to be provided for the black data writing of upper and lower blank regions.

Moreover, the conventional LCD 200 is adaptive to a simultaneous selection of respective SH blocks of those SH circuits which correspond to left and right blank regions to be displayed in black during a horizontal blanking period, thus permitting a relatively long interval of time to be provided as well for the black data writing of left and right blank regions.

Accordingly, the conventional LCD 200 is employable as a practical multi-purpose LCD.

However, the conventional LCDs 100 and 200 have their issues due to the use of an address decoder 104 or 204.

In the case of the LCD 100, as the number of scan lines GP-i increases, that of the control signal terminals 107-1~107-20 has to be increased as well as that of pairs of control lines AV-k and AV-k⁻, causing the size of an LCD module to be increased, resulting in an increased production cost.

For example, even the 1,024 scan lines require the 20 control signal terminals 107-1~107-20. If the number of scan lines exceeds 1,024, at least 22 terminals are required.

In the case of the LCD 200, as the number of data supply lines DS-j increases and/or that of data bus lines 207-1~207-16 or phases of picture data decreases, the number of the control signal terminals 206-1~206-14 has to be increased as well as that of pairs of control lines AH-r and AH-r⁻, causing the size of an LCD module to be increased, resulting in an increased production cost.

For example, even the 1,280 data supply lines connected to the data bus lines 207-p not less than 16 in number require the 14 control signal terminals 206-1~206-14. If the number of data bus lines decreases to 8 for the 1,280 data supply lines, there are required 16 control signal terminals.

The use of an address decoder thus provides an increased number of control signals of which a combination of logic levels is responsible for an address selection, so that increased noises and/or differences of timing between control signals tend to deteriorate a signal to noise (hereafter "SN") ratio of an output signal.

The present invention has been achieved with such points in mind.

SUMMARY OF THE INVENTION

It therefore is a first object of the present invention to provide a practical multi-purpose LCD of which peripheral drive circuitry is operative with a relatively small number of control signal terminals, permitting an improved SN ratio, an effective size reduction and an improved cost effect.

To achieve the first object, a genus of the present invention provides a liquid crystal display comprising: an active matrix array having switching elements thereof arranged at cross points between scan lines and data lines; a vertical drive circuit for driving the scan lines; and a horizontal drive circuit for driving the data lines; the vertical drive circuit comprising an N-staged scan circuit for providing N outputs of a pulse signal sequentially shifted by half a period of a clock signal, where N is a positive integer, N×M logic gate circuits having first control terminals of combinations of M logic gate circuits thereof common connected therebetween, respectively of those combinations, to be connected to N output terminals of the scan circuit, respectively, where M is an integer larger than unity, and second control terminals of combinations of logic gate circuits at intervals of 2×M−1 thereof common connected therebetween, respectively of these combinations, and output buffer circuits having output signals of the logic gate circuits as input signals thereto.

According to the genus of the invention, a practical multi-purpose LCD may be implemented with a number of control signal terminals within a reduced-range between a ⅗ to a half relative to a conventional case.

According to a species of the genus of the invention, the logic gate circuits each respectively comprise a 2-input NAND circuit.

According to another species of the genus of the invention, the scan circuit comprises circuit means for shifting the pulse signal in a two-way mode.

According to another species of the genus of the invention, the integer M is larger than three.

To achieve the first object, another genus of the present invention provides a liquid crystal display comprising: an active matrix array having switching elements thereof arranged at cross points between scan lines and data lines; a vertical drive circuit for driving the scan lines; and a horizontal drive circuit for driving the data lines; the horizontal drive circuit comprising an N-staged scan circuit for providing N outputs of a pulse signal sequentially shifted by half a period of a clock signal, where N is a positive integer, N×M first logic gate circuits having first control terminals of combinations of M first logic gate circuits thereof common connected therebetween, respectively of those combinations, to be connected to N output terminals of the scan circuit, respectively, where M is an integer larger than unity, and second control terminals of combinations of first logic gate circuits at intervals of 2×M−1 thereof common connected therebetween, respectively of these combinations, N×M second logic gate circuits having first control terminals thereof connected to output terminals of the first logic gate circuits and second control terminals thereof common connected therebetween, and N×M data sampling and holding switches having control terminals of combinations of J data sampling and holding switches thereof common connected therebetween, respectively of these combinations, to be connected to output terminals of the second logic gate circuits, respectively, where J is a positive integer, and input terminals of combinations of data sampling and holding switches at intervals of J−1 thereof common connected therebetween, respectively of these combinations.

According to a species of this genus of the invention, the first and second logic gate circuits each respectively comprise a 2-input NAND circuit.

According to another species of this genus of the invention, the scan circuit comprises circuit means for shifting the pulse signal in a two-way mode.

To achieve the first object, another genus of the present invention provides a liquid crystal display comprising: an active matrix array having switching elements thereof arranged at cross points between scan lines and data lines; a vertical drive circuit for driving the scan lines; and a horizontal drive circuit for driving the data lines; the horizontal drive circuit comprising an N-staged scan circuit for providing N outputs of a pulse signal sequentially shifted by half a period of a clock signal, where N is a positive integer, N×M logic gate circuits having first control terminals of combinations of M logic gate circuits thereof common connected therebetween, respectively of those combinations, to be connected to N output terminals of the scan circuit, respectively, where M is an integer larger than unity, and second control terminals of combinations of logic gate circuits at intervals of 2×M−1 thereof common connected therebetween, respectively of these combinations, output buffer circuits for inputting output signals of the logic gate circuits, and N×M data sampling and holding switches having control terminals of combinations of J data sampling and holding switches thereof common connected therebetween, respectively of these combinations, to be connected to output terminals of the output buffer circuits, respectively, where J is a positive integer, and input terminals of combinations of data sampling and holding switches at intervals of J−1 thereof common connected therebetween, respectively of these combinations.

According to these genus of the invention, a practical multi-purpose LCD may be implemented with a number of control signal terminals within a reduced range between a 9/14 to a half relative to a conventional case.

Such an effect may be advantageous with an increased number of pixels and/or a reduced number of image data multiplying phases.

Moreover, a complete cancellation of noises due to crosstalk permits a stable display service.

It is a second object of the present invention to provide a driving method of a practical multi-purpose LCD of which peripheral drive circuitry is operative with a relatively small number of control signal terminals, permitting an improved SN ratio, an effective size reduction and an improved cost effect.

To achieve the second object, another genus of the present invention provides a driving method for driving a liquid crystal display including an active matrix array having switching elements thereof arranged at cross points between scan lines and data lines, a vertical drive circuit for driving the scan lines, and a horizontal drive circuit for driving the data lines, the driving method comprising the steps of: providing in the vertical drive circuit an N-staged scan circuit for providing N outputs of a pulse signal sequentially shifted by half a period of a clock signal, where N is a positive integer; providing in the vertical drive circuit N×M logic gate circuits having first control terminals of combinations of M logic gate circuits thereof common connected therebetween, respectively of those combinations, to be connected to N output terminals of the scan circuit, respectively, where M is an integer larger than unity, and second control terminals of combinations of logic gate circuits at intervals of 2×M−1 thereof common connected therebetween, respectively of these combinations; and providing in the vertical drive circuit output buffer circuits having output signals of the logic gate circuits as input signals thereto.

According to a species of this genus of the invention, the driving method further comprising the steps of: inputting a clock signal having a period of 2×M×T to the scan circuit, where T is a scan line selection interval; sequentially inputting 2×M different pulse signals A-1, A-2, . . . , A-(2×M) to 2×M second control terminals G-1, G-2, . . . , G-(2×M) of the N×M logic gate circuits, the 2×M pulse signals having a pulse duration of T, a pulse period of 2×M×T and phases sequentially shifted by a period of T; and inputting the 2×M pulse signals for a driving in a timing meeting a relationship such that $0<(t1-t0)<\{(2\times M\times T)/2\}$, where t0 is a time when a logical level of a K-th output signal of the scan circuit is changed, where K is a positive integer, and t1 is a time after the time t0, when a logical level of a pulse signal to be input to a second control terminal of a $\{1+M\times(K-1)\}$-th logic gate circuit is changed.

According to another species of this genus of the invention, the driving method further comprising the steps of: inputting a clock signal having a period of 2×M×T to the scan circuit, where T is a scan line selection interval; inputting 2×M different pulse signals A-1, A-2, . . . , A-(2×M) in an reverse order to 2×M second control terminals G-1, G-2, . . . , G-(2×M) of the N×M logic gate circuits, the 2×M pulse signals having a pulse duration of T, a pulse period of 2×M×T and phases sequentially shifted by a period of T; and inputting the 2×M pulse signals for a driving in a timing meeting a relationship such that $0<(t1-t0)<\{(2\times M\times T)/2\}$, where t0 is a time when a logical level of a K-th output signal of the scan circuit is changed, where K is a positive integer, and t1 is a time after the time t0, when a logical level of a pulse signal to be input to a second control terminal of an (M×K)-th logic gate circuit is changed.

According to another species of this genus of the invention, the driving method further comprising the steps of: inputting a clock signal having a period of M×T to the scan circuit, where T is a scan line selection interval; sequentially inputting M different pulse signals A-1, A-2, . . . , A-M to combinations of 2×M second control terminals G-1 and G-2, G-3 and G-4, . . . , G-(2×M−1) and G-(2×M) of the N×M logic gate circuits, the M pulse signals having a pulse duration of T, a pulse period of M×T and phases sequentially shifted by a period of T; and inputting the M pulse signals for a driving in a timing meeting a relationship such that $0<(t1-t0)<\{(M\times T)/2\}$, where t0 is a time when a logical level of a K-th output signal of the scan circuit is changed, where K is a positive integer, and t1 is a time after the time t0, when a logical level of a pulse signal to be input to a second control terminal of a $\{1+M\times(K-1)\}$-th logic gate circuit is changed.

According to another species of this genus of the invention the driving method further comprising the steps of: inputting a clock signal having a period of M×T/2 to the scan circuit, where T is a scan line selection interval; sequentially inputting M/2 different pulse signals A-1, A-2, . . . , A-M/2 to combinations of 2×M second control terminals G-1~G-4, G-5~G-8, . . . , G-(2×M−3)~G-(2×M) of the N×M logic gate circuits, the M/2 pulse signals having a pulse duration of T, a pulse period of M×T/2 and phases sequentially shifted by a period of T; and inputting the M/2 pulse signals for a driving in a timing meeting a relationship such that $0<(t1-t0)<\{(M\times T)/4\}$, where t0 is a time when a logical level of a K-th output signal of the scan circuit is changed, where K is a positive integer, and t1 is a time after the time t0, when a logical level of a pulse signal to be input to a second control terminal of a $\{1+M\times(K-1)\}$-th logic gate circuit is changed.

According to another species of this genus of the invention, the driving method further comprising the steps of: inputting a clock signal having a period of M×T to the scan circuit, where T is a scan line selection interval; executing, in an odd-number field, sequentially inputting M different pulse signals A-1, A-2, . . . , A-M to second control terminals G-1, G-3, G-5, . . . , G-(2×M−1) of odd-number ordered ones of the N×M logic gate circuits, the M pulse signals having a pulse duration of T, a pulse period of M×T and phases sequentially shifted by a period of T, and inputting the M pulse signals for a driving in a timing meeting a relationship such that $0<(t1-t0)<\{(M\times T)/2\}$, where t0 is a time when a logical level of a K-th output signal of the scan circuit is changed, where K is a positive integer, and t1 is a time after the time t0, when a logical level of a pulse signal to be input to a second control terminal of a $\{1+M\times(K-1)\}$-th logic gate circuit is changed; and executing, in an even-number field, sequentially inputting M different pulse signals A-1, A-2, . . . , A-M to second control terminals G-2, G-4, G-6, . . . , G-(2×M) of even-number ordered ones of the N×M logic gate circuits, the M pulse signals having a pulse duration of T, a pulse period of M×T and phases sequentially shifted by a period of T, and inputting the M pulse signals for a driving in a timing meeting a relationship such that $0<(t1-t0)<\{(M\times T)/2\}$, where t0 is a time when a logical level of a K-th output signal of the scan circuit is changed, where K is a positive integer, and t1 is a time after the time t0, when a logical level of a pulse signal to be input to a second control terminal of a $\{2+M\times(K-1)\}$-th logic gate circuit is changed.

According to another species of this genus of the invention, the driving method further comprising the steps of: inputting to the scan circuit a clock signal having a clock period thereof modulatable from 2×M×T to $\{(2\times M-J)\times T\}$, where T is a scan line selection interval and J is a positive integer not exceeding M; sequentially inputting 2×M different pulse signals A-1, A-2, . . . , A-(2×M) to 2×M second control terminals G-1, G-2, , G-(2×M) of the N×M logic gate circuits, the 2×M pulse signals having a pulse duration of T and phases sequentially shifted by a period of T when the clock period is 2×M×T, excepting J points when the clock period is $\{(2\times M-J)\times T\}$; and inputting the 2×M pulse signals for a driving in a timing meeting a relationship such that $0<(t1-t0)<\{(2\times M\times T)/2\}$, where t0 is a time when a logical level of a K-th output signal of the scan circuit is changed, where K is a positive integer, and t1 is a time after the time t0, when a logical level of a pulse signal to be input to a second control terminal of a $\{1+M\times(K-1)\}$-th logic gate circuit is changed.

According to another species of this genus of invention, the liquid crystal display has a blanking period comprising a first period for inputting a clock signal of a predetermined period to the scan circuit to sequentially shift a pulse signal, a second period following the first period, for fixing a level of the clock signal to hold constant levels of the output signals of the scan circuit, and a third period following the second period, for inputting a clock signal of a predetermined period to the scan circuit to sequentially shift the pulse signal, the driving method further comprising the steps of: inputting, to the second control terminals of the logic gate circuits for a driving, a signal independent from the output signals of the logic gate circuits n the first and third periods and dependent thereon in the second period.

According to another species of this genus of the invention, the liquid crystal display has a blanking period comprising a first period for inputting a clock signal of a predetermined period to the scan circuit to sequentially shift a pulse signal, a second period following the first period, for fixing a level of the clock signal to hold constant levels of the output signals of the scan circuit, a third period following the second period, for changing the fixed level of the clock signal to effect a first shift of the pulse signal, a fourth period following the third period, for fixing a level of the clock signal to hold constant levels of the output signals of the scan circuit, and a fifth period following the fourth period, for inputting a clock signal of a predetermined period to the scan circuit to sequentially shift the pulse signal, the driving method further comprising the steps of: inputting, to the second control terminals of the logic gate circuits for a driving, a signal independent from the output signals of the logic gate circuits in the first, third and fifth periods and dependent thereon in at least one of the second and fourth periods.

According to another species of this genus of the invention, in a blanking period, a clock signal to be input to the scan circuit is modulated to a higher frequency than in an image writing period, to transfer a pulse signal, and in the transfer period, an output of the scan circuit causes a signal reflective on outputs of the logic gate circuits to be input for a driving to the second control terminals of the logic gate circuits.

To achieve the second object, another genus of the present invention provides a driving method for a liquid crystal display including an active matrix array having switching elements thereof arranged at cross points between scan lines and data lines, a vertical drive circuit for driving the scan lines, and a horizontal drive circuit for driving the data lines, the driving method comprising the steps of: providing in the horizontal drive circuit an N-staged scan circuit for providing N outputs of a pulse signal sequentially shifted by half a period of a clock signal, where N is a positive integer; providing in the horizontal drive circuit N×M first logic gate circuits having first control terminals of combinations of M first logic gate circuits thereof common connected therebetween, respectively of those combinations, to be connected to N output terminals of the scan circuit, respectively, where M is an integer larger than unity, and second control terminals of combinations of first logic gate circuits at intervals of 2×M−1 thereof common connected therebetween, respectively of these combinations; providing in the horizontal drive circuit N×M second logic gate circuits having first control terminals thereof connected to output terminals of the first logic gate circuits and second control terminals thereof common connected therebetween; and providing in the horizontal drive circuit N×M data sampling and holding switches having control terminals of combinations of J data sampling and holding switches thereof common connected therebetween, respectively of these combinations, to be connected to output terminals of the second logic gate circuits, respectively, where J is a positive integer, and input terminals of combinations of data sampling and holding switches at intervals of J−1 thereof common connected therebetween, respectively of these combinations.

According to a species of this genus of the invention, the driving method further comprising the steps of: inputting a clock signal having a period of 2×M×T to the scan circuit, where T is a scan line selection interval; sequentially inputting 2×M different pulse signals A-1, A-2, . . . , A-(2×M) to second control terminals D-1, D-2, . . . , D-(2×M) of the N×M first logic gate circuits, the 2×M pulse signals having a pulse duration between 0 and $\{(M+1)\times T\}$, a pulse period of 2×M×T and phases sequentially shifted by a period of T; and having outputs of the first logic circuits cause a signal reflective on outputs of the second logic gate circuits to be input for a driving to the second control terminals of the second logic gate circuits.

According to another species of this genus of the invention, the driving method further comprising the steps of: inputting a clock signal having a period of 2×M×T to the scan circuit, where T is a scan line selection interval; inputting 2×M different pulse signals A-1, A-2, . . . , A-(2×M) in a reverse order to second control terminals D-1, D-2, . . . , D-(2×M) of the N×M first logic gate circuits, the 2×M pulse signals having a pulse duration between 0 and $\{(M+1)\times T\}$, a pulse period of 2×M×T and phases sequentially shifted by a period of T; and having outputs of the first logic circuits cause a signal reflective on outputs of the second logic gate circuits to be input for a driving to the second control terminals of the second logic gate circuits.

According to another species of this genus of the invention, the driving method further comprising having in a vertical blanking period outputs of the first logic gate circuits cause a signal non-reflective on outputs of the second logic gate circuits to be input to the second control terminals of the second logic gate circuits and a signal level representative of a black display input to J input terminals of the sampling and holding switches.

According to another species of this genus of the invention, in a horizontal blanking period, a clock signal to be input to the scan circuit is modulated to a higher frequency than in an image writing period, to transfer a pulse signal, and in the transfer period, outputs of the scan circuit cause a signal reflective on outputs of the first logic gate circuits to be input to the second control terminals of the first logic gate circuits, and outputs of the first logic gate circuits cause a signal reflective on outputs of the second logic gate circuits to be input to the second control terminals of the second logic gate circuits and a signal level representative of a black display to be input to J input terminals of the sampling and holding switches, for a driving.

To achieve the second object, another genus of the present invention provides a driving method for a liquid crystal display including an active matrix array having switching elements thereof arranged at cross points between scan lines and data lines, a vertical drive circuit for driving the scan lines, and a horizontal drive circuit for driving the data lines, the driving method comprising the steps of: providing in the horizontal drive circuit an N-staged scan circuit for providing N outputs of a pulse signal sequentially shifted by half a period of a clock signal, where N is a positive integer; providing in the horizontal drive circuit N×M logic gate circuits having first control terminals of combinations of M logic gate circuits thereof common connected therebetween, respectively of those combinations, to be connected to N output terminals of the scan circuit, respectively, where M is an integer larger than unity, and second control terminals of combinations of logic gate circuits at intervals of 2×M−1 thereof common connected therebetween, respectively of these combinations; providing in the horizontal drive circuit output buffer circuits for inputting output signals of the logic gate circuits; and providing in the horizontal drive circuit N×M data sampling and holding switches having control terminals of combinations of J data sampling and holding switches thereof common connected therebetween, respectively of these combinations, to be connected to output terminals of the output buffer circuits, respectively, where J is a positive integer, and input terminals of combinations of data sampling and holding switches at intervals of J−1 thereof common connected therebetween, respectively of these combinations.

According to a species of this genus of the invention, in a vertical blanking period, a clock signal of a predetermined period is input to the scan circuit, and outputs of the scan circuit cause a signal reflective on outputs of the logic gate circuits to be input to the second control terminals of the logic gate circuits and a signal level representative of a black display to be input to J input terminals of the data sampling and holding switches, for a driving.

BRIEF DESCRIPTION OF THE DRAWINGS

The objects, features and advantages of the present invention will become more apparent from consideration of the following detailed description, in conjunction with the accompanying drawings, in which.

DESCRIPTION OF THE PREFERRED EMBODIMENTS

Figure 1:
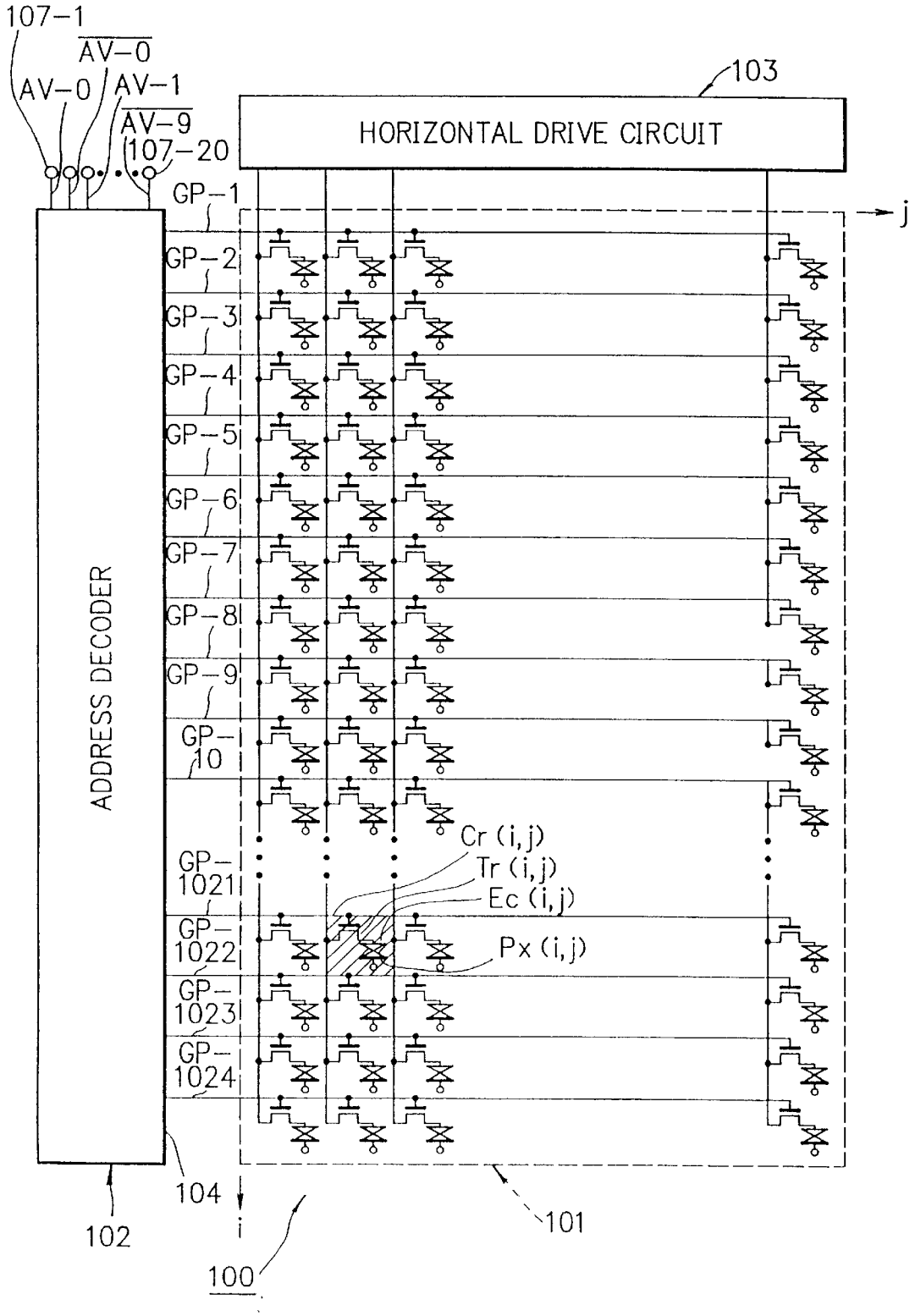
FIG. 1 PRIOR ART
FIG. 1 is a circuit diagram of a conventional multi-purpose LCD with a vertical drive circuit composed of an address decoder.
Figure 2:
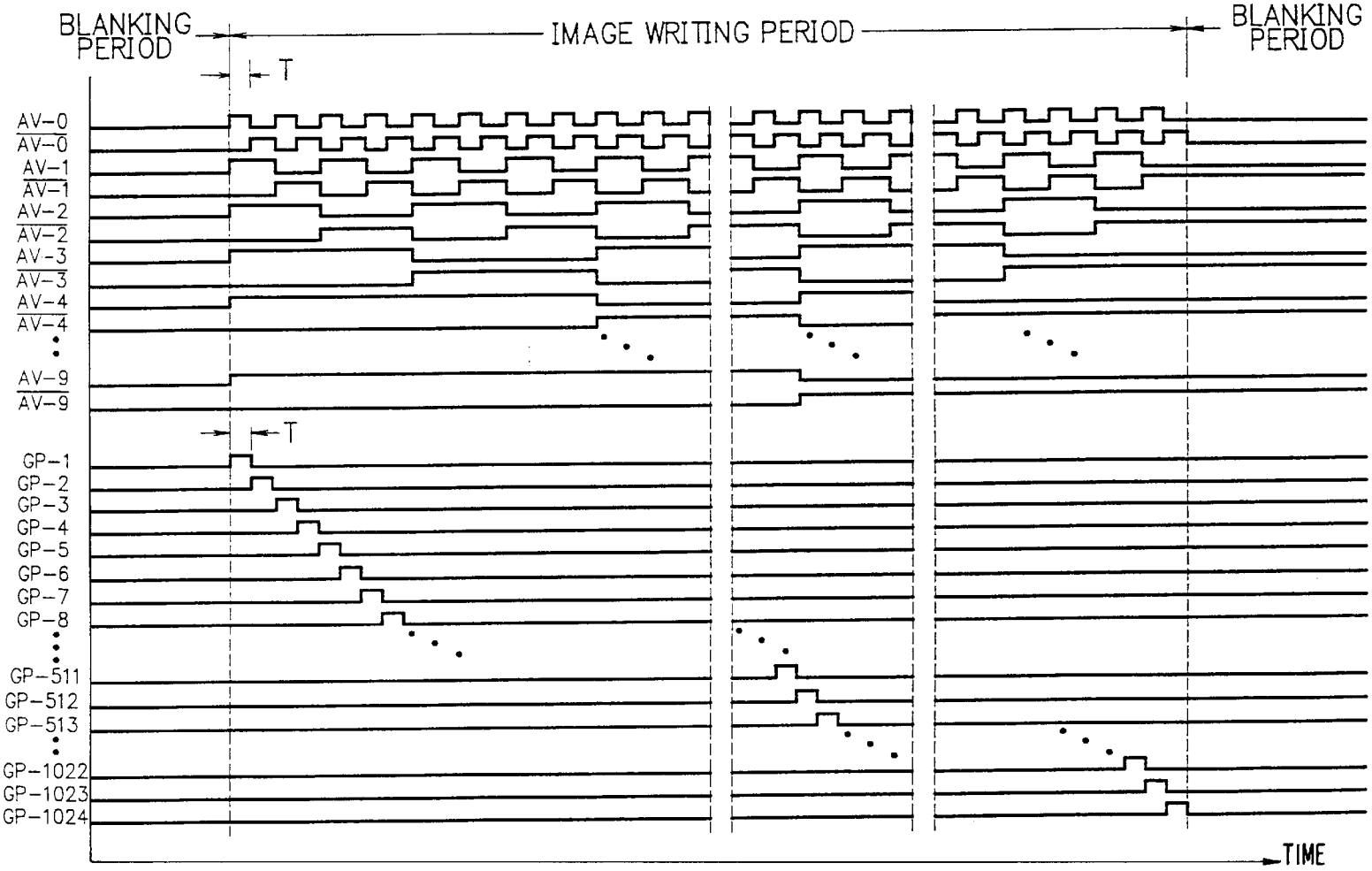
FIG. 2 PRIOR ART
FIG. 2 shows time charts of signals associated with a non-interlacing sequential scan mode in the conventional multi-purpose LCD of FIG. 1.
Figure 3:
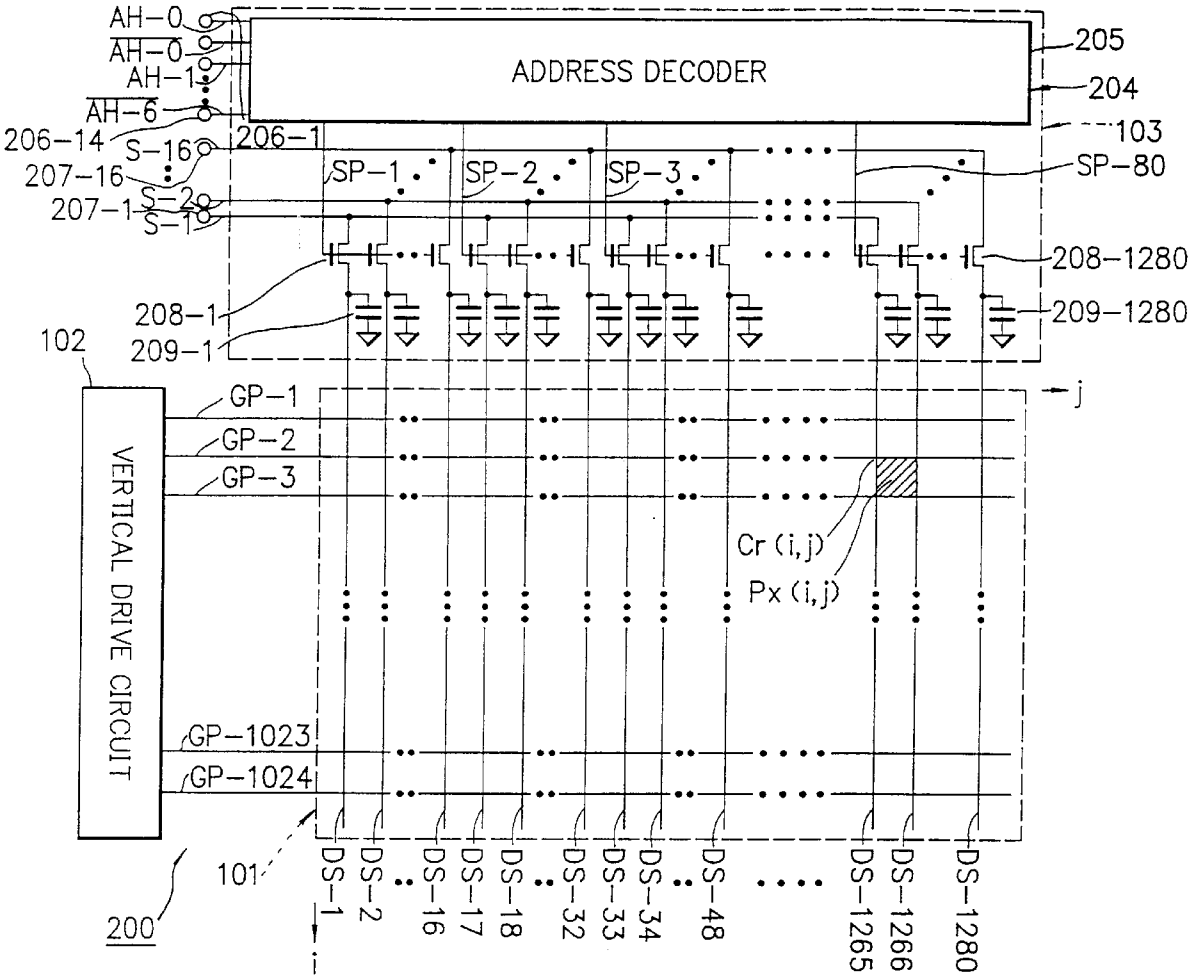
FIG. 3 PRIOR ART
FIG. 3 is a circuit diagram of a conventional multi-purpose LCD with a horizontal drive circuit composed of an address decoder.
Figure 4:
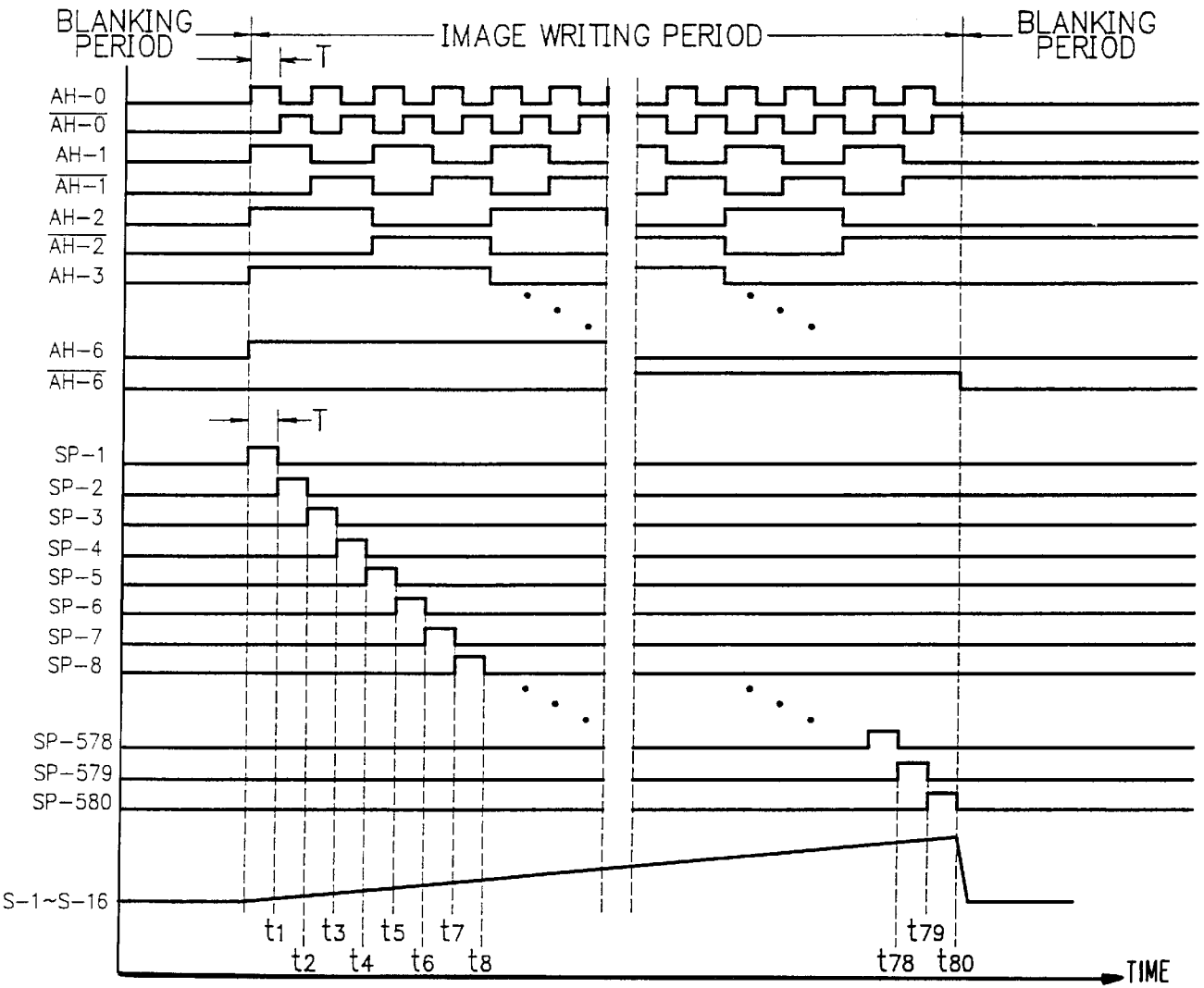
FIG. 4 PRIOR ART
FIG. 4 shows time charts of signals associated with a horizontal sequential scan in the conventional multi-purpose LCD of FIG. 3.

There will be detailed below preferred embodiments of the present invention with reference to the accompanying drawings. Like items or members are designated at like reference characters. Signal lines and signals thereon are designated by common reference characters, unless otherwise specified.

Figure 5:
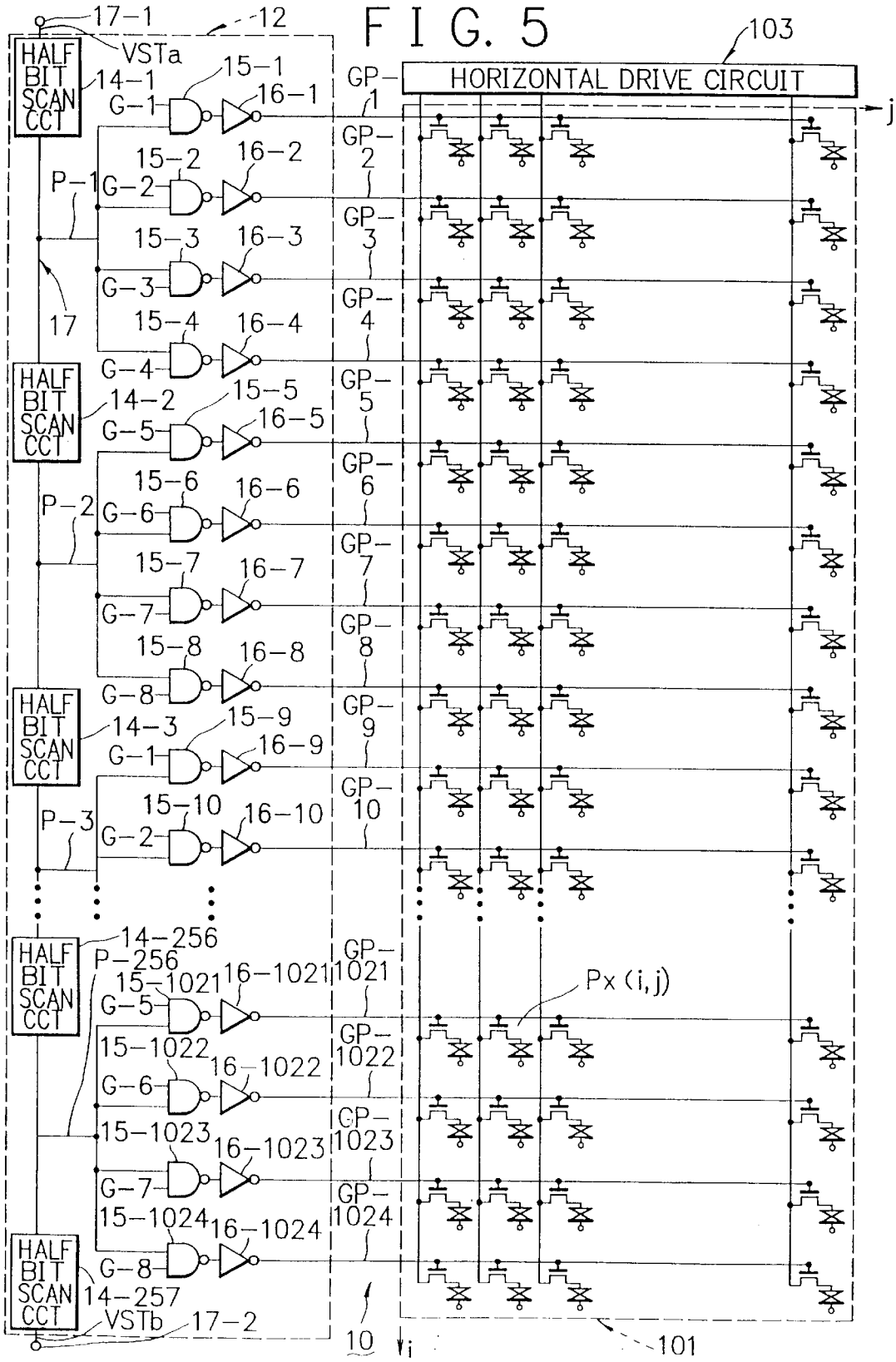
FIG. 5 is a circuit diagram of a multi-purpose LCD with a vertical drive circuit according to an embodiment of the present invention.

Referring now to FIG. 5, designated at reference character 10 is an LCD according to a preferred embodiment of the present invention. The LCD 10 comprises a liquid crystal display member 101 composed of a back-lighted transparent pixel layer consisting of a matrix of 1,024×1,280 active pixels Px(i, j) cooperatively defining a square display area, and peripheral drive circuitry 12–103 including a vertical drive circuit 12 connected to 1,024 rows of the matrix of pixels Px(i, j) via 1,024 (=4×256) parallel scan lines GP-1~GP-1024 and a horizontal drive circuit 103 connected to 1,280 columns of the matrix of pixels Px(i, j) via 1,280 parallel data lines.

The vertical drive circuit 12 comprises 257 (=256+1) half-bit scan circuits 14-1~14-257 of which respective interconnections are connected via 1,024 parallel NAND gate circuits 15-1~15-1024 and 1,024 parallel inverting output buffer circuits 16-1~16-1024 to the scan lines GP-1~GP-1024.

The half-bit scan circuits 14-1~14-257 are connected in series therebetween to constitute a pulse signal shift circuit 17. The shift circuit 17 is provided with a first terminal 17-1 for receiving a pulse signal VSTa input thereto as a drive signal for a downward vertical scan, and a second terminal 17-2 for receiving a pulse signal VSTb input thereto as a drive signal for an upward vertical scan, thus permitting a two-way scan. In the shift circuit 17, the input pulse signal VSTa or VSTb is shifted in either of two directions in synchronism with one of paired dual-phase clock signals CLK (FIGS. 6 and 7), which is selected as a drive signal for the shifting in either direction, so that 256 scan signals P-1~P-256 are available from the 256 interconnections between the 257 half-bit scan circuits with a delay equivalent to half a pulse cycle of the selected clock signal CLK. The shift circuit 17 thus selectively employs four drive signals in total.

The 1,024 NAND gate circuits 15-i and the 1,024 output buffer circuits 16-i are grouped into 256 circuit blocks of which an s-th one (s is an arbitrary integer such that $1 \leqq s \leqq 256$) consists of continuous four 15-(4s-3)~15-4s of the NAND gate circuits 15-i and continuous four 16-(4s-3)~16-4s of the buffer circuits 16-i of which output terminals are connected to corresponding four GP-(4s-3)~GP-4s of the scan lines GP-i. The four gate circuits 15-(4s-3)~15-4s are connected at their first input terminals via a common terminal to the interconnection between neighboring two 14-s and 14-(s+1) of the 257 half-bit circuits 14-1~14-257 to receive therefrom a corresponding one P-s of the scan signals P-1~P-256, and at their output terminals in parallel to input terminals of the four buffer circuits 16-(4s-3)~16-4s.

Thus, letting $s_0$ be s of an arbitrary odd number, every pair of $s_0$-th and $s_0$+1-th ones of the 256 circuit blocks includes continuous eight 15-(4$s_0$-3)~15-4($s_0$+1) of the NAND gate circuits 15-i, which eight circuits 15-(4$s_0$−3) 15(4$s_0$+4) have their second input terminals connected in parallel to unshown input terminals of eight different drive signals as control signals G-1~G-8 of the NAND gates.

Thus, letting N (=256) be a number of block circuits and M (=4) be a number of logic gate circuits (15-i) in each block circuit, a respective (s-th) one of N combinations of continuous M of a total of M×N (=1,024 ) logic gate circuits has respective first input terminals of the continuous M logic gate circuits connected via a common terminal to a corresponding (s-th) one of N interconnections between N+1 (=257) cascaded half-bit scan circuits (14-s), i. e. to an output terminal of a corresponding (s-th) one of N half-bit scan circuits of a shift circuit (17) operative in a two-way mode with selected two of four scan drive signals.

And a respective one of 2M (=8) combinations of such N/2 (=128) of the M×N (=1,024 ) logic gate circuits that appear every 2M-th (=8-th) place or at intervals of 2M−1 (=7) of the M×N logic gate circuits has respective second input terminals of the N/2 logic gate circuits connected to respective common terminals of 2M gate drive signals.

Accordingly, a total of drive signals to be input to a vertical drive circuit (12) does not exceed 2M(=8) +4, which is equivalent to 12 in the present embodiment, which is a ⅗ when compared with the conventional LCD 100 in which the number of required control signal terminals for an address decoder amounts to 20.

If the number of scan lines exceeds 1,024, at least 22 control signals are required in a conventional case using an address decoder. However, in an LCD according to the embodiment, the number of drive signal terminals for a vertical drive circuit is suppressed to about half of a conventional figure.

In the present embodiment, the pulse signal shift circuit 17 is composed of cascaded 256 half-bit scan circuits 14-s of which outputs P-s are input to 256 combinations of four NAND gate circuits 15-i to drive 1,024 scan lines GP-i.

In a modification of the embodiment, a pulse signal shift circuit may preferably be composed of cascaded 512 half-bit scan circuits of which outputs are input to 512 combinations of two NAND gate circuits to drive 1,024 scan lines.

In the modification, the NAND gate circuits may have a number of control signals thereof left as it is eight, or reduced to four.

The present embodiment employs the 1,024 NAND gate circuits 15-i, which may be replaced by 1,024 NOR gate circuits in a modification. In this case, the NOR gate circuits may receive input signals opposite in logical level to the output signals P-s of the half-bit scan circuits 14-s of the embodiment, and the inverting output buffer circuits 16-i may be substituted by non-inverting buffer circuits.

Figure 6:
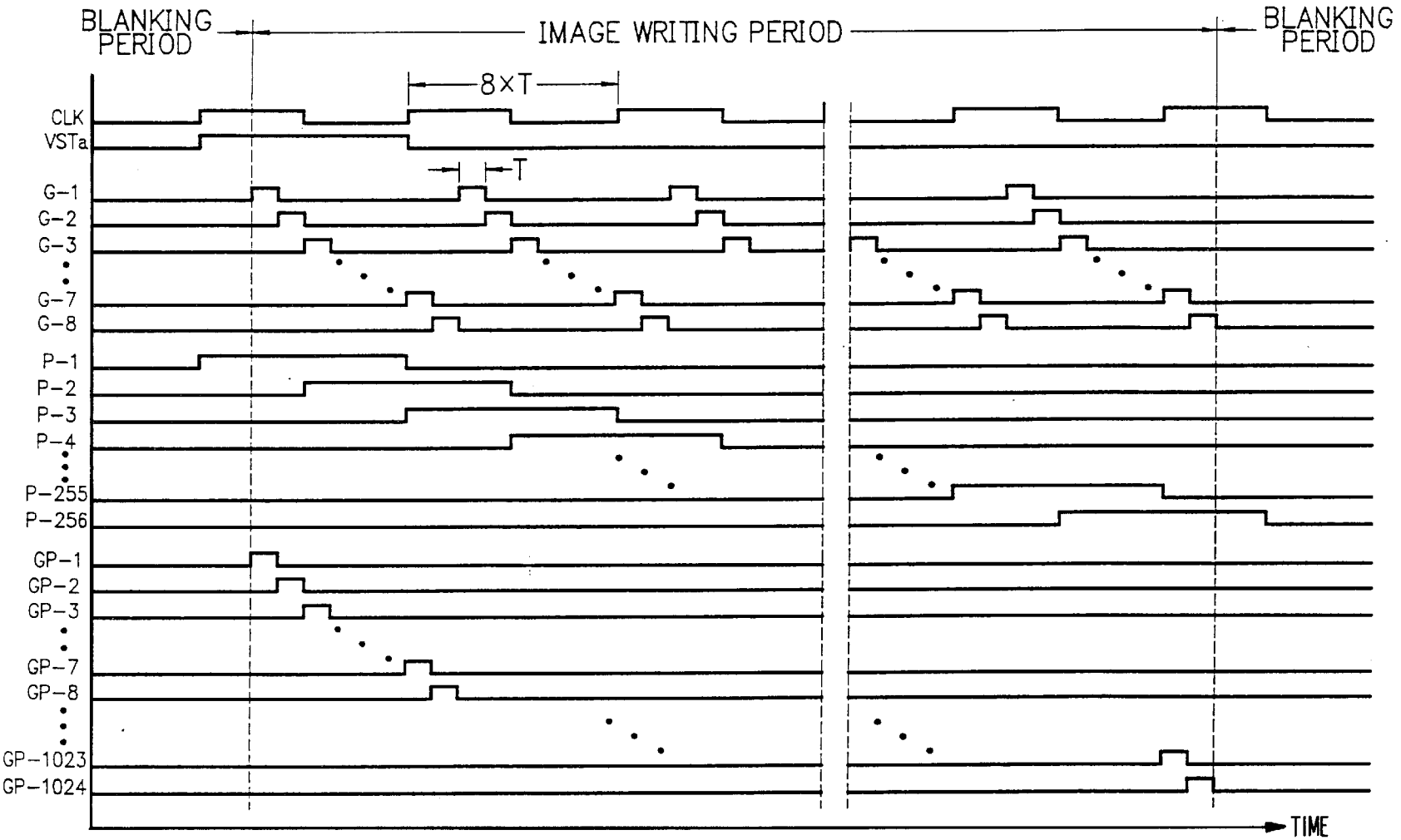
FIG. 6 shows time charts of signals associated with a driving for a downward sequential scan of the LCD of FIG. 5, in accordance with an embodiment of the present invention.

FIG. 6 shows time charts of signals associated with a downward sequential scan mode of the multi-purpose LCD 10 of FIG. 5.

As shown in FIG. 6, letting T be a scan line selection interval, a clock signal CLK having a clock period of 8×T is input to the 257 half-bit scan circuits 14-s and a pulse signal VSTa having a pulse duration of 8×T is input to the shift circuit 17 from the input terminal 17-1, at shown times in the figure. The pulse signal VSTa is sequentially shifted in synchronism with the clock signal CLK, so that 256 half-bit scan circuits 14-1~14-256 output as output signals P-1~P-256 thereof 256 pulse signals having a pulse duration of 8×T and sequentially shifted in phase by a period of 4×T.

The shift circuit 17 adaptive to a driving with a pair of selective dual-phase clock signals may have an external clock signal input thereto with a reverse phase to the above clock signal CLK.

Moreover, as shown in FIG. 6, eight pulse signals G-1~G-8 having a pulse duration of T, a pulse period of 8×T and their phases sequentially shifted by a period of T are input as control signals of the 1,024 NAND gate circuits 15-i.

As a result, the 1,024 output buffer circuits 16-i output as scan signals GP-i therefrom 1,024 pulse signals having a pulse duration of T and their phases sequentially shifted by a period of T.

Like this, there are output signals for a downward sequential scan mode.

In the present embodiment, letting n be an arbitrary positive integer not exceeding 128, the control signal G-1 input to a NAND gate circuit 15-(1+8(n−1)) (i.e. 15-(8n−7)) has a rise timing thereof delayed by 2×T from a rise timing of an output signal P-(2n−1) of a (2n−1)-th half-bit scan circuit 14-(2n−1). Likewise, each of other control signals G-2~G-8 is delayed to thereby completely erase crosstalk noises in an output signal.

If the output signal P-(2n−1) of the half-bit scan circuit 14-(2n−1) has the same rise timing as the control signal G-1 input to the NAND gate circuit 15-(1+8(n−1)), associated output signals of the vertical drive circuit 12 may have noises caused therein with a lapse of time of 7×T after they have fallen.

Figure 7:
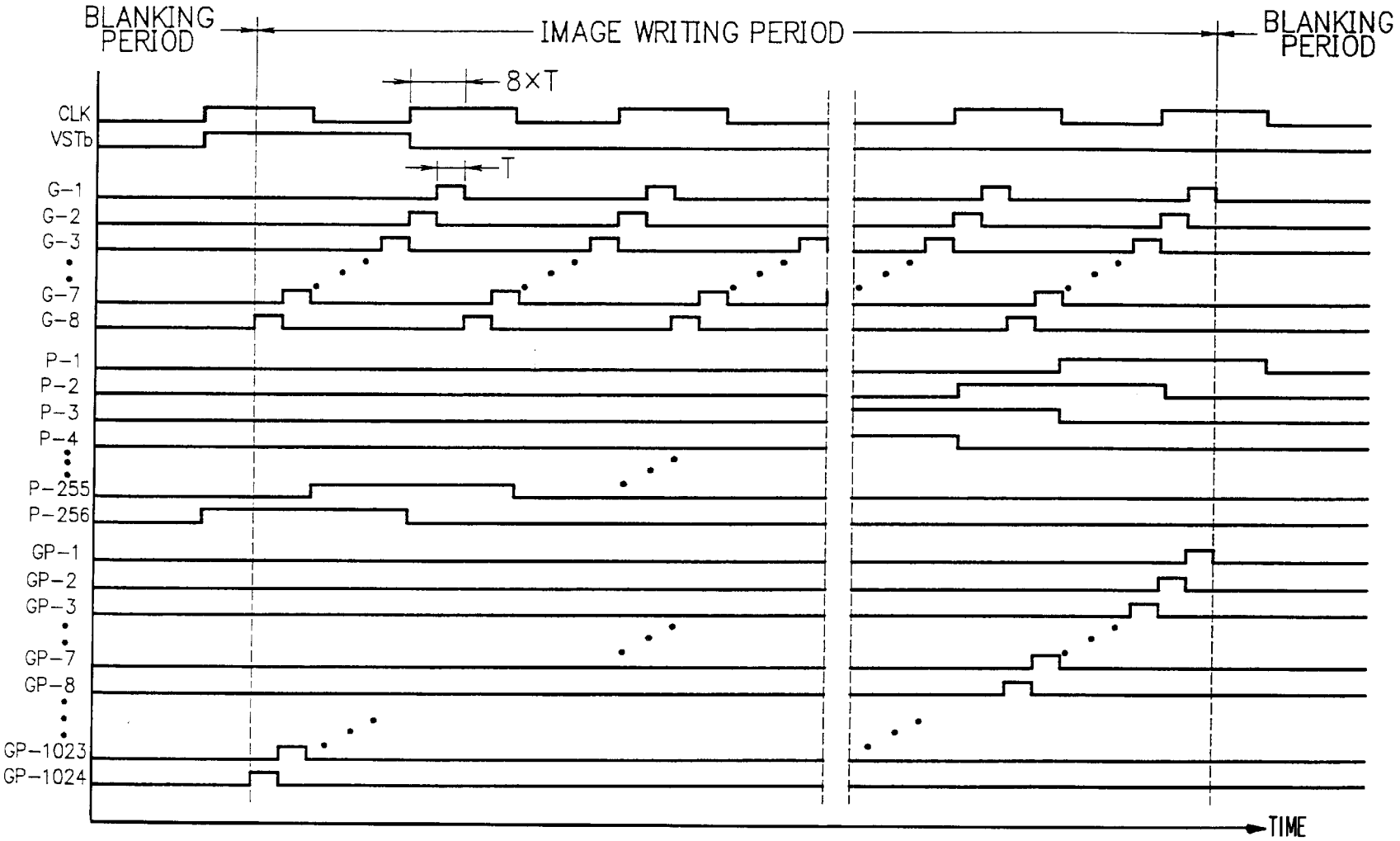
FIG. 7 shows time charts of signals associated with a driving of the LCD of FIG. 5, for an upward sequential scan in accordance with an embodiment of the present invention.

FIG. 7 shows time charts of signals associated with an upward sequential scan mode of the multi-purpose LCD 10 of FIG. 5.

As shown in FIG. 7, letting T be a scan line selection interval, a clock signal CLK having a clock period of 8×T is input to the 257 half-bit scan circuits 14-s and a pulse signal VSTb having a pulse duration of 8×T is input to the shift circuit 17 from the input terminal 17-2, at shown times in the figure. The pulse signal VSTb is sequentially shifted in synchronism with the clock signal CLK in a reverse direction to FIG. 6, so that 256 half-bit scan circuits 14-257~14-2 output as output signals P-256~P-1 thereof 256 pulse signals having a pulse duration of 8×T and sequentially shifted in phase by a period of 4×T in a reverse direction.

Like the case of FIG. 6, the shift circuit 17 may have an external clock signal input thereto from the input terminal 17-2 with a reverse phase to the above clock signal CLK.

Moreover, as shown in FIG. 7, eight pulse signals G-1~G-8 having a pulse duration of T, a pulse period of 8×T and their phases sequentially shifted by a period of T in a reverse direction are input as control signals of the 1,024 NAND gate circuits 15-i.

As a result, the 1,024 output buffer circuits 16-i output as scan signals GP-i therefrom 1,024 pulse signals having a pulse duration of T and their phases sequentially shifted by a period of T in a reverse direction.

Like this, there are output signals for an upward sequential scan mode.

In the present embodiment, letting n be an arbitrary positive integer not exceeding 128, the control signal G-8 input to a NAND gate circuit 15-8n has a rise timing thereof delayed by 2×T from a rise timing of an output signal P-2n of a 2n-th half-bit scan circuit 14-2n. Likewise, each of other control signals G-7~G-1 is delayed to thereby completely erase crosstalk noises in an output signal.

If the output signal P-2n of the half-bit scan circuit 14-2n has the same rise timing as the control signal G-8 input to the NAND gate circuit 15-8n, associated output signals of the vertical drive circuit 12 may have noises caused therein with a lapse of time of 7×T after they have fallen.

Figure 8:
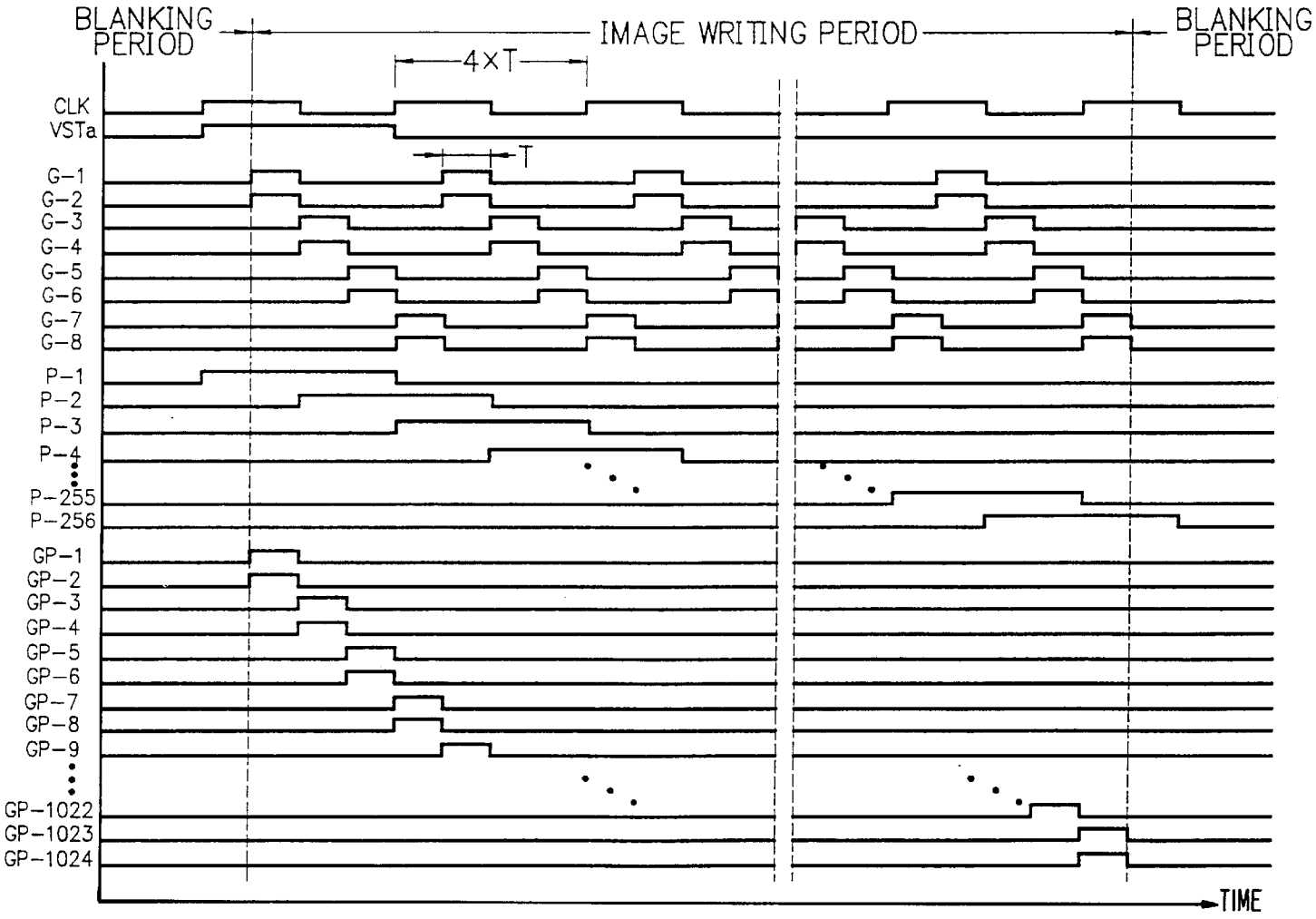
FIG. 8 shows time charts of signals associated with a driving of the LCD of FIG. 5, for a picture expansion to a double in vertical and horizontal directions in accordance with an embodiment of the present invention.

FIG. 8 shows time charts of signals associated with a driving for a picture expansion to a double in both vertical and horizontal directions of the multi-purpose LCD 10 of FIG. 5. The double expansion needs a dual-line simultaneous scan and a distribution of an image data to a pair of neighboring data lines.

As shown in FIG. 8, letting T be a scan line selection interval, a clock signal CLK having a clock period of 4×T is input to the 257 half -bit scan circuits 14-s and a pulse signal VSTa having a pulse duration of 4×T is input to the shift circuit 17 from the input terminal 17-1, at shown times in the figure. The pulse signal VSTa is sequentially shifted in synchronism with the clock signal CLK, so that 256 half -bit scan circuits 14-1~14-256 output as output signals P-1~P-256 thereof 256 pulse signals having a pulse duration of 4×T and sequentially shifted in phase by a period of 2×T.

The shift circuit 17 adaptive to a driving with a pair of selective dual-phase clock signals may have an external clock signal input thereto with a reverse phase to the above clock signal CLK.

Moreover, as shown in FIG. 8, the control pulses G-1 and G-2, G-3 and G-4, G-5 and G-6, and G-7 and G-8 are common connected to provide four pulse signals having a pulse duration of T, a pulse period of 4×T and their phases sequentially shifted by a period of T are input as control signals of the 1,024 NAND gate circuits 15-i.

As a result, the 1,024 output buffer circuits 16-i output as scan signals GP-i therefrom 512 pairs of pulse signals adaptive to the dual-line simultaneous scan.

The horizontal drive circuit 103 may be adapted for the distribution of an image data to a pair of neighboring data lines.

Thus, the LCD 10 is adaptive to the picture expansion to a double in both vertical and horizontal directions.

The present embodiment may be applied to a dual-line simultaneous scan in such a mode that in each odd-numbered field, when scanning an odd number line to write therein image data, a subsequent even number line is simultaneously scanned to write those data, and in each even-numbered field, when scanning an even number line to write therein image data, a subsequent odd number line is simultaneously scanned to write these data.

In the present embodiment, letting n be an arbitrary positive integer not exceeding 128, the control signal G-1 input to a NAND gate circuit 15-(1+8(n−1)) has a rise timing thereof delayed by T from a rise timing of an output signal P-(2n−1) of a (2n−1)-th half-bit scan circuit 14-(2n−1). Likewise, each of other control signals G-2~G-8 is delayed to thereby completely erase crosstalk noises in an output signal.

If the output signal P-(2n−1) of the half-bit scan circuit 14-(2n−1) has the same rise timing as the control signal G-1 input to the NAND gate circuit 15-(1+8(n−1)), associated output signals of the vertical drive circuit 12 may have noises caused therein with a lapse of time of 3×T after they have fallen.

Figure 9:
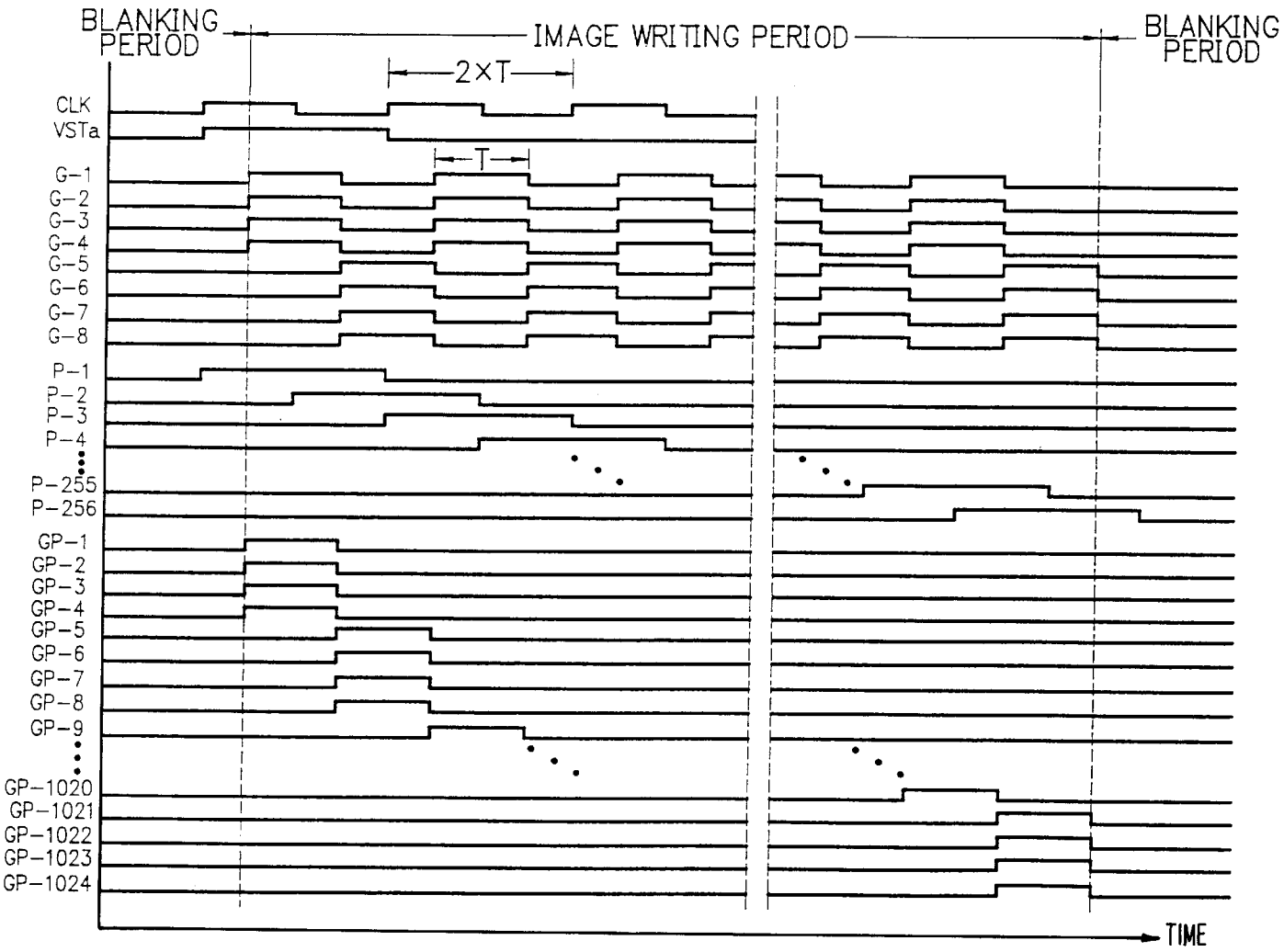
FIG. 9 shows time charts of signals associated with a driving of the LCD of FIG. 5, for a picture expansion to a 4-fold in vertical and horizontal directions in accordance with an embodiment of the present invention.

FIG. 9 shows time charts of signals associated with a driving for a picture expansion to a 4-fold in both vertical and horizontal directions of the multi-purpose LCD 10 of FIG. 5. The 4-fold expansion needs a 4-line simultaneous scan and a distribution of an image data to a quartet of neighboring data lines.

As shown in FIG. 9, letting T be a scan line selection interval, a clock signal CLK having a clock period of 2×T is input to the 257 half -bit scan circuits 14-s and a pulse signal VSTa having a pulse duration of 2×T is input to the shift circuit 17 from the input terminal 17-1, at shown times in the figure. The pulse signal VSTa is sequentially shifted in synchronism with the clock signal CLK, so that 256 half -bit scan circuits 14-1~14-256 output as output signals P-1~P-256 thereof 256 pulse signals having a pulse duration of 2×T and sequentially shifted in phase by a period of T.

The shift circuit 17 adaptive to a driving with a pair of selective dual-phase clock signals may have an external clock signal input thereto with a reverse phase to the above clock signal CLK.

Moreover, as shown in FIG. 9, the control pulses G-1~G-4 and G-5~G-8 are common connected to provide two pulse signals having a pulse duration of T, a pulse period of 2×T and their phases shifted by a period of T are input as control signals of the 1,024 NAND gate circuits 15-i.

As a result, the 1,024 output buffer circuits 16-i output as scan signals GP-i therefrom 256 quartets of pulse signals adaptive to the 4-line simultaneous scan.

The horizontal drive circuit 103 may be adapted for the distribution of an image data to a quartet of neighboring data lines.

Thus, the LCD 10 is adaptive to the picture expansion to a 4-fold in both vertical and horizontal directions.

In the present embodiment, letting n be an arbitrary positive integer not exceeding 128, the control signal G-1 input to a NAND gate circuit 15-(1+8(n−1)) has a rise timing thereof delayed by T/2 from a rise timing of an output signal P-(2n−1) of a (2n−1)-th half-bit scan circuit 14-(2n−1). Likewise, each of other control signals G-2~G-8 is delayed to thereby completely erase crosstalk noises in an output signal.

If the output signal P-(2n−1) of the half-bit scan circuit 14-(2n−1) has the same rise timing as the control signal G-1 input to the NAND gate circuit 15-(1+8(n−1)), associated output signals of the vertical drive circuit 12 may have noises caused therein with a lapse of time of T after they have fallen.

Figure 10:
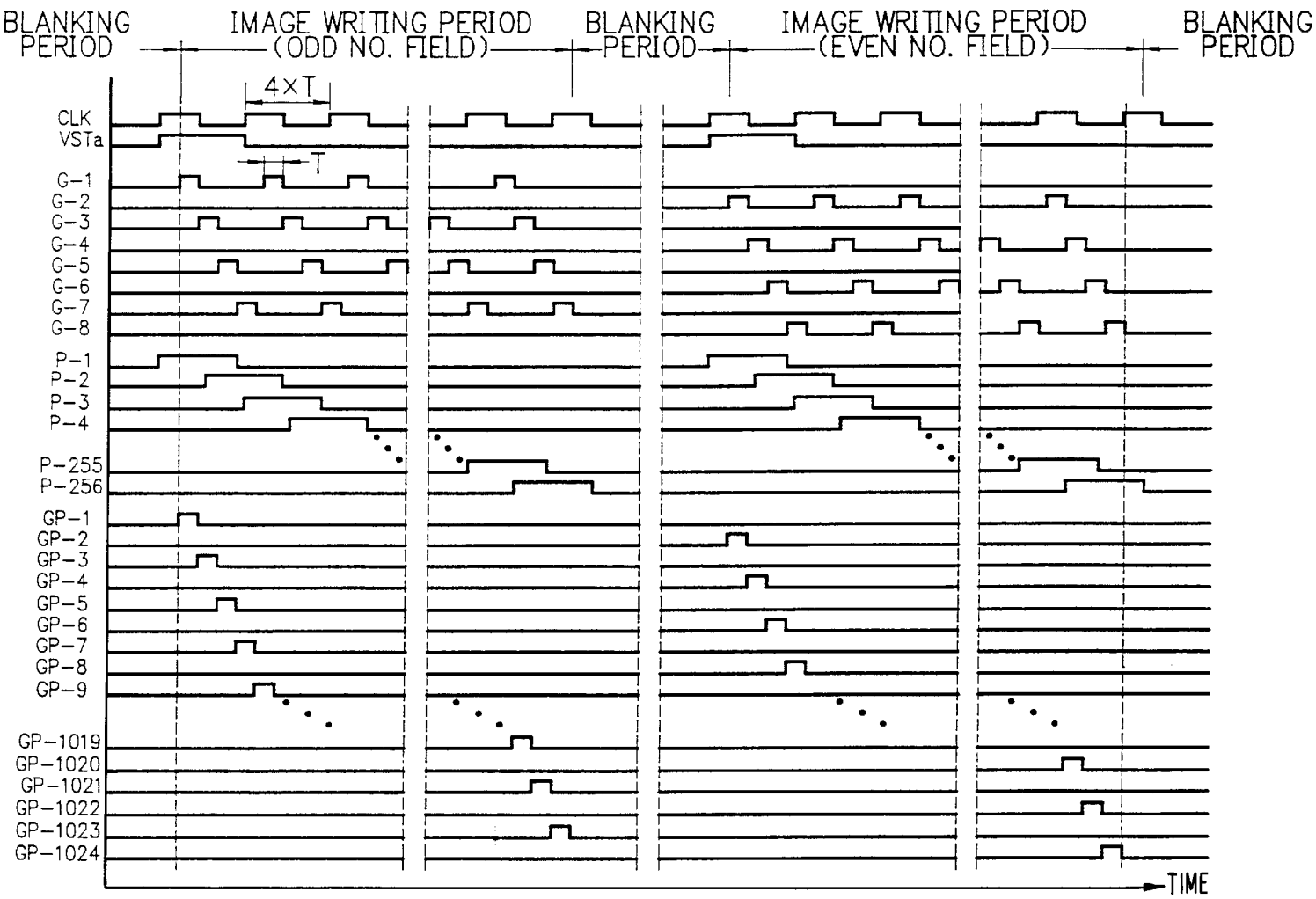
FIG. 10 shows time charts of signals associated with a driving of the LCD of FIG. 5, for an interlacing scan in accordance with an embodiment of the present invention.

FIG. 10 shows time charts of signals associated with an interlacing scan of the multi-purpose LCD 10 of FIG. 5, in which a predetermined number of sequentially ordered scan lines are scanned in an interlacing manner so that in each odd-numbered field, odd number lines are sequentially scanned, and in each even-numbered field, even number lines are sequentially scanned.

As shown in FIG. 10, in an odd-numbered field, letting T be a scan line selection interval, a clock signal CLK having a clock period of 4×T is input to the 257 half -bit scan circuits 14-s and a pulse signal VSTa having a pulse duration of 4×T is input to the shift circuit 17 from the input terminal 17-1, at shown times in the figure. The pulse signal VSTa is sequentially shifted in synchronism with the clock signal CLK, so that 256 half -bit scan circuits 14-1~14-256 output as output signals P-1~P-256 thereof 256 pulse signals having a pulse duration of 4×T and sequentially shifted in phase by a period of 2×T.

The shift circuit 17 adaptive to a driving with a pair of selective dual-phase clock signals may have an external clock signal input thereto with a reverse phase to the above clock signal CLK.

Moreover, as shown in FIG. 10, the four control pulses G-1, G-3, G-5 and G-7 having a pulse duration of T, a pulse period of 4×T and their phases sequentially shifted by a period of T are input as control signals of the 1,024 NAND gate circuits 15-i.

As a result, the 1,024 output buffer circuits 16-i output as scan signals GP-i therefrom pulse signals adaptive to a sequential scan of odd-numbered scan lines.

Then, in an even-numbered field, letting T be a scan line selection interval, a clock signal CLK having a clock period of 4×T is input to the 257 half -bit scan circuits 14-s and a pulse signal VSTa having a pulse duration of 4×T is input to the shift circuit 17 from the input terminal 17-1, at shown times in the figure. The pulse signal VSTa is sequentially shifted in synchronism with the clock signal CLK, so that 256 half -bit scan circuits 14-1~14-256 output as output signals P-1~P-256 thereof 256 pulse signals having a pulse duration of 4×T and sequentially shifted in phase by a period of 2×T.

The shift circuit 17 adaptive to a driving with a pair of selective dual-phase clock signals may have an external clock signal input thereto with a reverse phase to the above clock signal CLK.

Moreover, as shown in FIG. 10, the four control pulses G-2, G-4, G-6 and G-8 having a pulse duration of T, a pulse period of 4×T and their phases sequentially shifted by a period of T are input as control signals of the 1,024 NAND gate circuits 15-i.

As a result, the 1,024 output buffer circuits 16-i output as scan signals GP-i therefrom pulse signals adaptive to a sequential scan of even-numbered scan lines.

In the present embodiment, letting n be an arbitrary positive integer not exceeding 128, the control signal G-1 input to a NAND gate circuit 15-(1+8(n−1)) has a rise timing thereof delayed by T from a rise timing of an output signal P-(2n−1) of a (2n−1)-th half-bit scan circuit 14-(2n−1), or the control signal G-5 input to a NAND gate circuit 15-(5+8(n−1)) has a rise timing thereof delayed by T from a rise timing of an output signal P-2n of a 2n-th half-bit scan circuit 14-2. Likewise, each of other control signals is delayed to thereby completely erase crosstalk noises in an output signal.

If the output signal P-(2n−1) of the half-bit scan circuit 14-(2n−1) has the same rise timing as the control signal G-1 input to the NAND gate circuit 15-(1+8(n−1)) or if the output signal P-2n of the half-bit scan circuit 14-2n has the same rise timing as the control signal G-5 input to the NAND gate circuit 15-(5+8(n−1)), associated output signals of the vertical drive circuit 12 may have noises caused therein with a lapse of time of 3×T after they have fallen.

Figure 11:
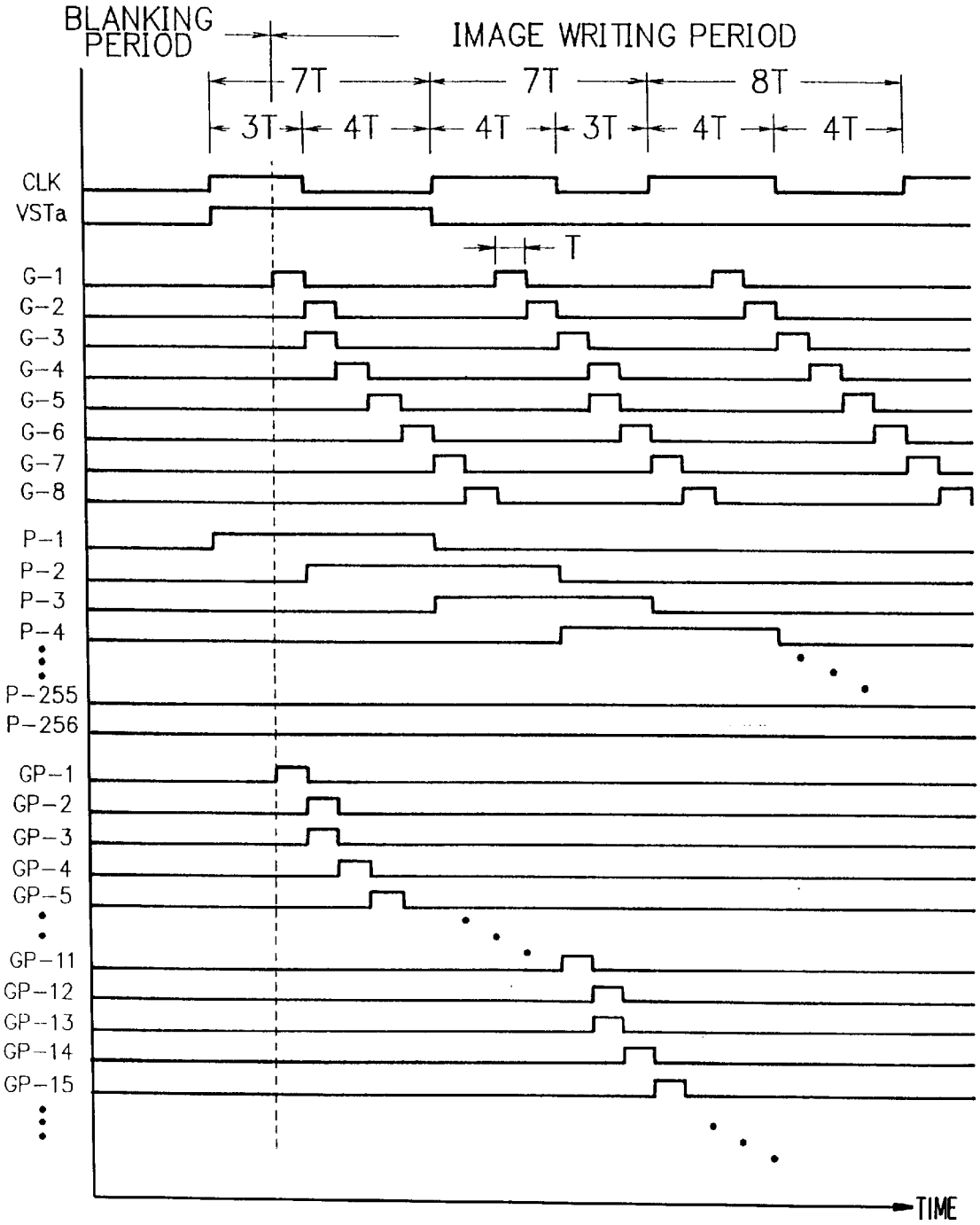
FIG. 11 shows time charts of signals associated with a driving of the LCD of FIG. 5, for a picture expansion to a 1. 6-fold in a vertical direction in accordance with an embodiment of the present invention.

FIG. 11 shows time charts of signals associated with a driving for a flexible picture expansion such as to a 1.6-fold in a vertical direction of the multi-purpose LCD 10 of FIG. 5. The flexible expansion needs a dual-line simultaneous scan to be partially effected in a single-line sequantial scan.

First, as shown in FIG. 11, letting T be a scan line selection interval, there are input a clock signal CLK having a duty ratio of 3/7 and a clock period of 7×T and a pulse signal VSTa having a pulse duration of 7×T, at shown times in the figure. The pulse signal VSTa is shifted in synchronism with the clock signal CLK, so that a half-bit scan circuit 14-1 outputs as an output signal P-1 thereof a pulse signal having a pulse duration of 7×T shifted as shown.

The shift circuit 17 adaptive to a driving with a pair of selective dual-phase clock signals may have an external clock signal input thereto with a reverse phase to the above clock signal CLK.

Moreover, while the pulse signal P-1 is being output, four pulses G-1~G-4 having a pulse duration of T and their phases sequentially shifted by a period of T except a third one are input as control signals of the 1,024 NAND gate circuits 15-i, at shown times.

As a result, the output buffer circuits 16-i output as scan signals GP-1~GP-4 therefrom pulse signals having a pulse duration of T and their phases sequentially shifted by a period of T except a third one.

Like this, a second GP-2 and a third scan line GP-3 can be simultaneously selected.

Then, as shown in FIG. 11, the clock signal to be input to the half-bit scan circuits 14-s is modulated to a clock signal having a duty ratio of 4/7 and a clock period of 7×T , so that a half-bit scan circuit 14-2 outputs as an output signal P-2 thereof a pulse signal having a pulse duration of 8×T shifted as shown and a half-bit scan circuit 14-3 outputs as an output signal P-3 thereof a pulse signal having a pulse duration of 7×T shifted as shown.

Moreover, while the pulse signal P-2 is being output, four pulses G-5~G-8 having a pulse duration of T and their phases sequentially shifted by a period of T are input as control signals of the NAND gate circuits 15-i, at shown times.

As a result, the output buffer circuits 16-i output as scan signals GP-5~GP-8 therefrom pulse signals having a pulse duration of T and their phases sequentially shifted by a period of T.

Further, while the pulse signal P-3 is being output, four pulses G-1~G-4 having a pulse duration of T and their phases sequentially shifted by a period of T are input as control signals of the NAND gate circuits 15-i, at shown times.

As a result, the output buffer circuits 16-i output as scan signals GP-9~GP-12 therefrom pulse signals having a pulse duration of T and their phases sequentially shifted by a period of T.

Then, as shown in FIG. 11, the clock signal to be input to the half-bit scan circuits 14-s is modulated to a clock signal having a duty ratio of 1/2 and a clock period of 8×T , so that a half-bit scan circuit 14-4 outputs as an output signal P-4 thereof a pulse signal having a pulse duration of 7×T shifted as shown.

Moreover, while the pulse signal P-4 is being output, four pulses G-5~G-8 having a pulse duration of T and their phases sequentially shifted by a period of T are input as control signals of the NAND gate circuits 15-i, in a manner in which control signals G-4 and G-5 have a matching phase to each other as shown.

As a result, the output buffer circuits 16-i output as scan signals GP-13~GP-16 therefrom pulse signals having a pulse duration of T and their phases sequentially shifted by a period of T, in such a timing that the output signals P-12 and P-13 have a matching phase to each other.

Like this, a 12-th GP-12 and a 13-th scan line GP-13 can be simultaneously selected.

Thus, a dual-line simultaneous scan is partially effected in a single-line sequential scan.

The present embodiment may be applied to a dual-line simultaneous scan in such a mode that in each odd-numbered field, when scanning an odd number line to write therein image data, a subsequent even number line is simultaneously scanned to write those data, and in each even-numbered field, when scanning an even number line to write therein image data, a subsequent odd number line is simultaneously scanned to write these data.

In the present embodiment, letting n be an arbitrary positive integer not exceeding 128, the control signal G-1 input to a NAND gate circuit 15-(1+8(n−1)) has a rise timing thereof delayed by T or 2×T from a rise timing of an output signal P-(2n−1) of a (2n−1)-th half-bit scan circuit 14-(2n−1), and an output signal P-(2n−1) of a (2n-l)-th half-bit scan circuit 14-(2n−1) has a fall timing thereof delayed by T or 2×T from a fall timing of the control signal G-4 input to a NAND gate circuit 15-(4+8(n−1)).

Moreover, the control signal G-5 input to a NAND gate circuit 15-(5+8(n−1)) has a rise timing thereof delayed by T or 2×T from a rise timing of an output signal P-2n of a 2n-th half-bit scan circuit 14-2n, and an output signal P-2n of a 2n-th half-bit scan circuit 14-2n has a fall timing thereof delayed by T or 2×T from a fall timing of the control signal G-8 input to a NAND gate circuit 15-8n.

Likewise, each control signal G-1~G-8 is shifted to thereby completely erase crosstalk noises in output signals.

Figure 12:
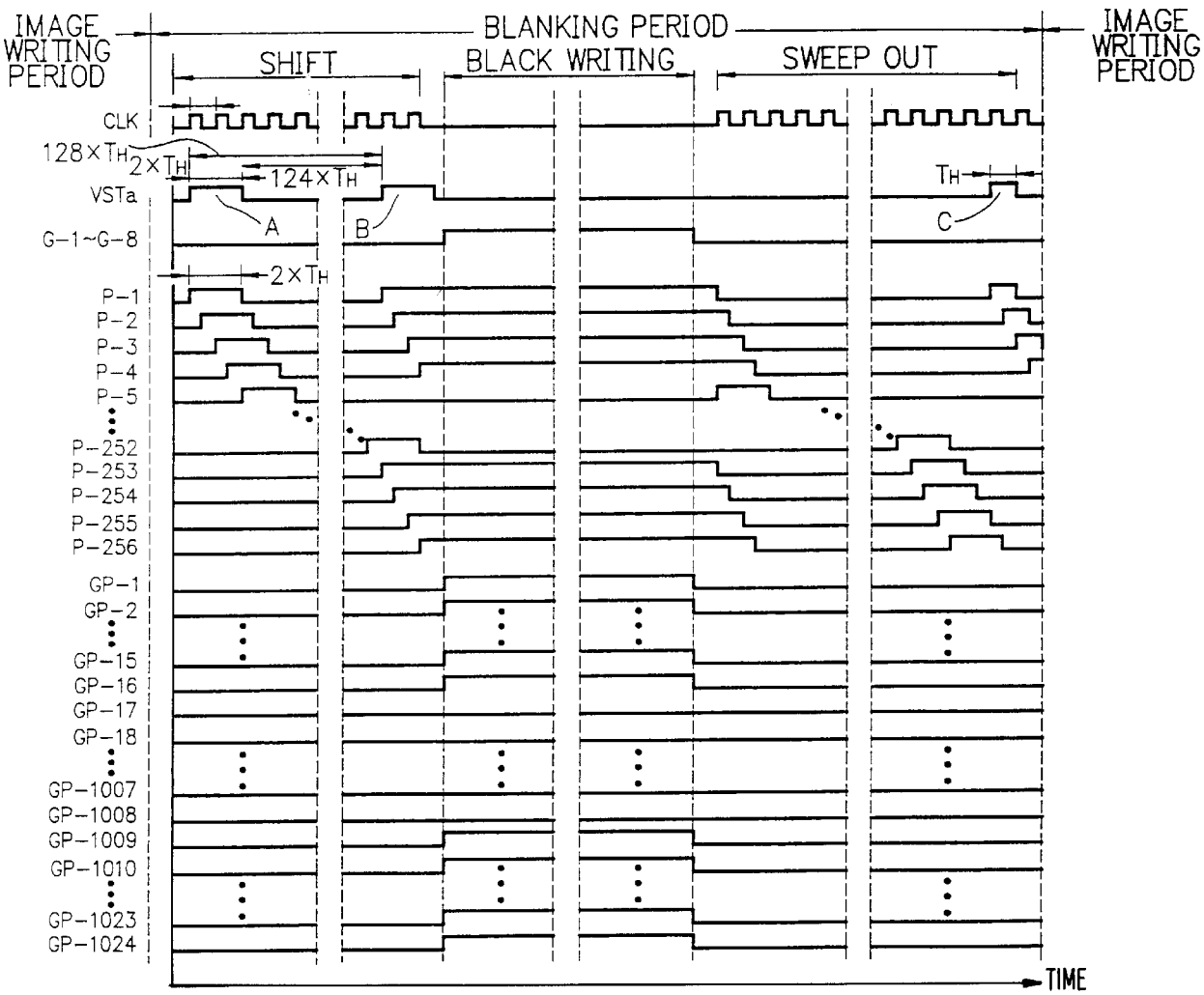
FIG. 12 shows time charts of signals associated with a driving of the LCD of FIG. 5, for writing a black data in upper and lower blank regions in accordance with an embodiment of the present invention.

FIG. 12 shows time charts of signals associated with a driving for writing a black data in upper and lower blank regions of a display area, when the multi-purpose LCD 10 of FIG. 5 responds to a picture signal formatted for a smaller number of pixels than 1,024×1,280. The upper and lower blank regions are supposed to be both equivalent to 16 scan lines.

First, as shown in FIG. 12, in a blanking period, a clock signal CLK having a clock period of TH is input to the 257 half-bit scan circuits 14-s and a pair of pulse signals A and B having a pulse duration of 2×TH are input to the shift circuit 17 as the input signal VSTa from the input terminal 17-1, at shown times in the figure. The interval between a falling edge of the pulse signal A and a rising edge of the pulse signal B is equivalent to 124×TH.

With the clock signal CLK and the input signal VSTa (=A+B) input, the shift circuit 17 shifts the pulse signals A and B, so that the half-bit scan circuits 14-s outputs as the output signals P-s pairs of pulse signals with phases sequentially shifted by a period of TH/2 as shown.

During such a period, the control signals G-1~G-8 of the NAND gate circuits 15-i are input at a low level.

As a result, output signals GP-i of the vertical drive circuit 12 are held at a low level irrespective of logical levels of the output signals P-s of the half-bit scan circuits 14-s.

During that period, the clock signal CLK has a frequency (1/TH) higher by about three figures than that in an image writing period, so that the pulse signals A and B are shifted at a high speed.

Then, after a lapse of 128×TH from the input of the pulse A, the clock signal CLK is held at a level, so that output signals P-1~P-4 and P-253~P-256 of the half-bit scan circuits 14-s are held at a high level as shown.

In that period, the control signals G-1~G-8 of the NAND gate circuits 15-i are input at a high level.

Thus, while the control signals G-1~G-8 are held at the high level, output signals GP-1~GP-16 and GP-1009~GP-1024 of the vertical drive circuit 12 have a high level.

During this period, a black data is written to pixels Px(i, j) connected to any of the upper 16 scan lines and the lower 16 scan lines.

The black data writing period is set to be long enough to write the data to all the associated pixels Px(i, j).

The number of scan lines to be selected for the black data writing is adjustable by controlling pulse durations of the signals A and B.

After the black data writing period, the clock signal CLK of the clock period of TH is again input to the half-bit scan circuits 14-s so that those data held therein are rapidly swept out.

In this period, the control signals G-1~G-8 of the NAND gate circuits 15-i are input at a low level.

As a result, output signals GP-i of the vertical drive circuit 12 are held at a low level irrespective of logical levels of the output signals P-s of the half-bit scan circuits 14-s.

Further, during that period, a pulse signal C having a pulse duration of TH is input to be transferred to a 4-th stage to thereby generate a scan pulse signal for a subsequent image writing period.

Thus, in the image writing period, a transfer begins at a 5-th stage so that a scan starts at a 17-th scan line that resides in a picture region of the display area of the LCD 10.

Figure 13:
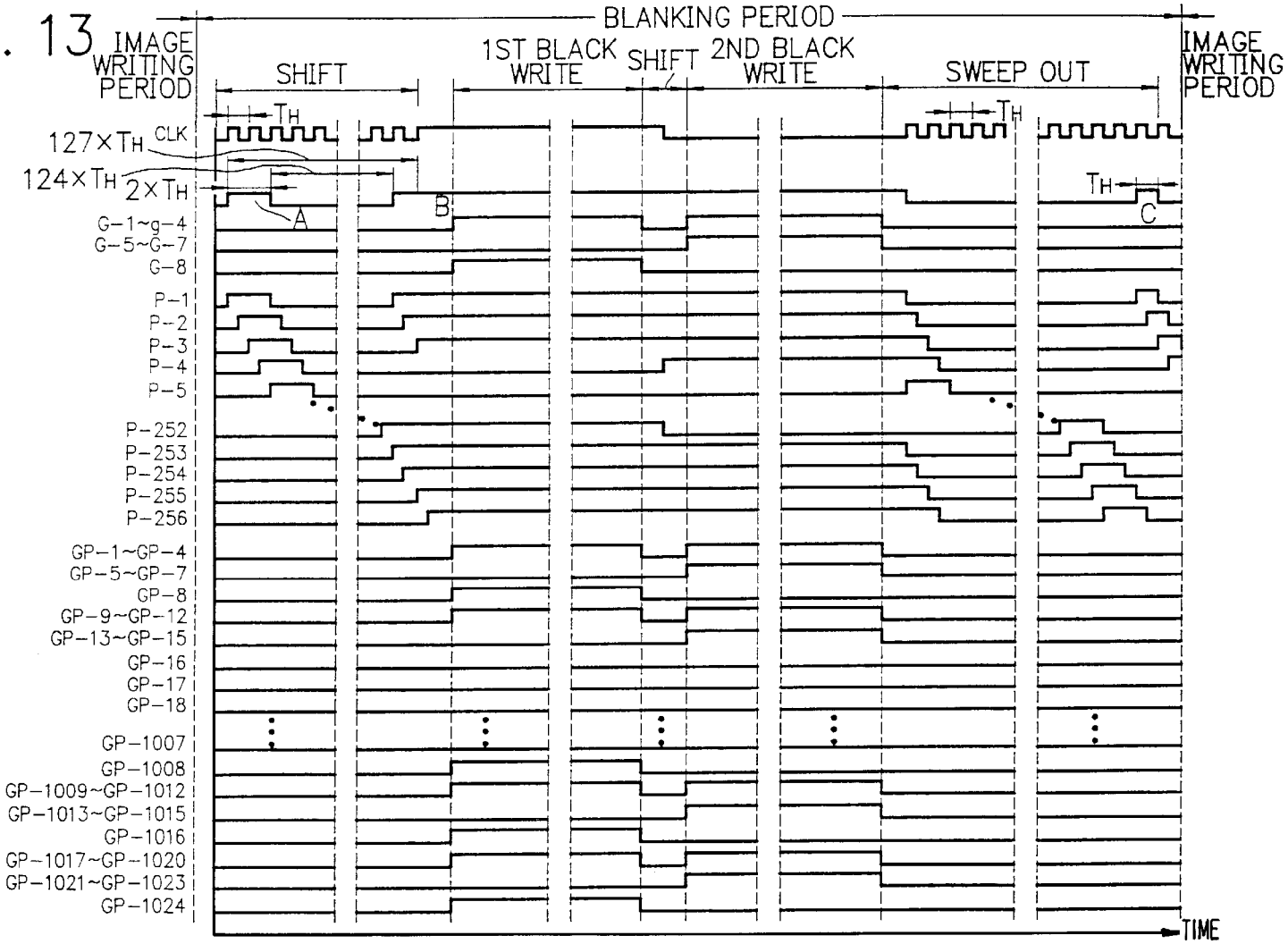
FIG. 13 shows time charts of signals associated with a driving of the LCD of FIG. 5, for writing a black data in upper and lower blank regions to perform an upward displacement of a picture formatted for a smaller number of pixels, in accordance with an embodiment of the present invention.

FIG. 13 also shows time charts of signals associated with a driving for writing a black data in upper and lower blank regions of a display area, when the multi-purpose LCD 10 of FIG. 5 responds to a picture signal formatted for a smaller number of pixels than 1,024×1,280. In this case, however, the upper and lower blank regions are supposed to be equivalent to 15 and 17 scan lines, respectively, which means a single-line upward displacement of a picture region so that the present embodiment is applicable to a flexible image displacement.

First, as in FIG. 13, in a blanking period, a clock signal CLK having a clock period of TH is input to the 257 half-bit scan circuits 14-s and a pair of pulse signals A and B are input to the shift circuit 17 as the input signal VSTa from the input terminal 17-1, at shown times in the figure. The interval between a falling edge of the pulse signal A and a rising edge of the pulse signal B is equivalent to 124×TH.

With the clock signal CLK and the input signal VSTa (=A+B) input, the shift circuit 17 shifts the pulse signals A and B, so that the half-bit scan circuits 14-s outputs as the output signals P-s pairs of pulse signals with phases sequentially shifted by a period of TH/2 as shown.

During such a period, the control signals G-1~G-8 of the NAND gate circuits 15-i are input at a low level.

As a result, output signals GP-i of the vertical drive circuit 12 are held at a low level irrespective of logical levels of the output signals P-s of the half-bit scan circuits 14-s.

During that period, the clock signal CLK has a frequency (1/TH) higher by about three figures than that in an image writing period, so that the pulse signals A and B are shifted at a high speed.

Then, after a lapse of 127×TH from the input of the pulse A, the clock signal CLK is held at a level, so that output signals P-1~P-3 and P-252~P-256 of the half-bit scan circuits 14-s are held at a high level as shown. This period will be referenced as "first black write period".

In the first black write period, control signals G-1~G-4 and G-8 of the NAND gate circuits 15-i are input at a high level, and control signals G-5~G-7 of the NAND gate circuits 15-i are input at a low level. Thus, output signals GP-1 GP-4, GP-8, GP-9~GP-12, GP-1008, GP-1009~GP-01012, GP-1016. GP-1017~GP-1020, and GP-1024 of the vertical drive circuit 12 have a high level.

During this period, a black data is written to pixels Px(i, j) in part of the black display region.

Thereafter, as in FIG. 13, the clock signal CLK has a changed a level so that an output signal P-4 of the half-bit scan circuit 14-4 is changed from a low level to a high level and an output signal P-252 of the half-bit scan circuit 14-252 is changed from a high level to a low level and hence output signals P-1~P-4 and P-253~P-256 have a high level.

During this period, the control signals G-1~G-8 of the NAND gate circuits 15-i are input at a low level, and output signals GP-i of the vertical drive circuit 12 are held at a low level irrespective of logical levels of the output signals P-s of the half-bit scan circuits 14-s.

Then, with the clock signal level held, the control signals G-1~G-7 to be input to the NAND gate circuits 15-i are set at a high level, the control signal G-8 is set at a low level.

As a result, output signals GP-1~GP-7, GP-9~GP-15, GP-1009~GP-10105, and GP-1017~GP-1023 of the vertical drive circuit 12 have a high level.

During this period, a black data is written to pixels Px(i, j) in part of the black display region. This period will be referenced as "second black write period".

After the first and second black write periods, the clock signal CLK of the clock period of TH is again input to the half-bit scan circuits 14-s so that those data held therein are rapidly swept out.

In this period, the control signals G-1~G-8 of the NAND gate circuits 15-i are input at a low level.

As a result, output signals GP-i of the vertical drive circuit 12 are held at a low level irrespective of logical levels of the output signals P-s of the half-bit scan circuits 14-s.

Further, during that period, a pulse signal C having a pulse duration of TH is input to be transferred to a 4-th stage to thereby generate a scan pulse signal for a subsequent image writing period.

Thereafter, the clock frequency is modulated, and sequentially shifted pulses are input as the control signals of the logic gate circuits in an order of G-8, G-1, G-2, . . . , G-7.

Thus, in the image writing period, a vertical scan by output signals of the vertical drive circuit 12 starts at a 16-th scan line that resides in the picture region of the LCD 10.

Therefore, a single-line displacement can be effected in a flexible manner.

Figure 14:
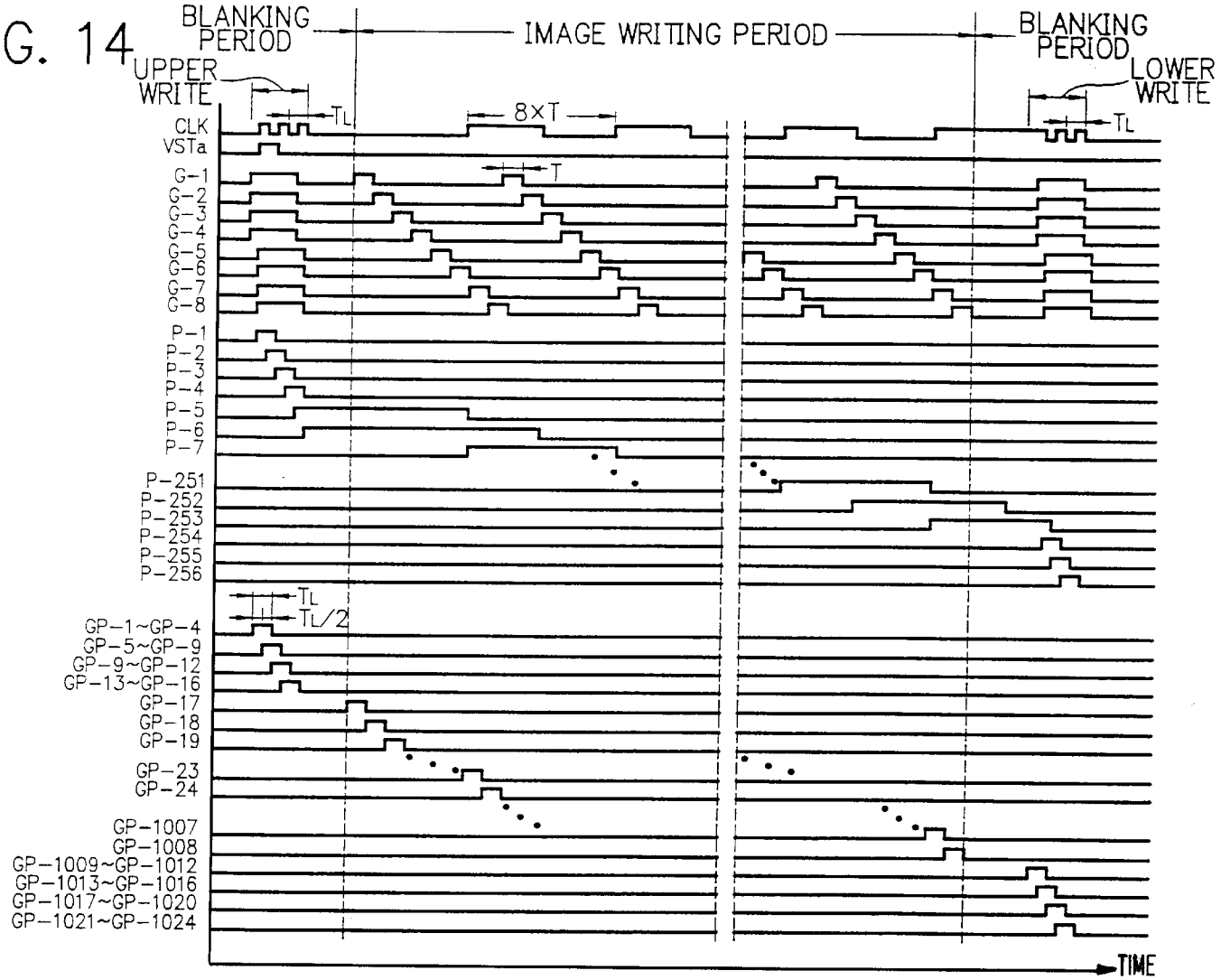
FIG. 14 shows time charts of signals associated with a driving of the LCD of FIG. 5, for writing a black data in upper and lower blank regions in a modified manner in accordance with an embodiment of the present invention.

FIG. 14 shows time charts of signals associated with another driving method for writing a black data in upper and lower blank regions of a display area, when the multi-purpose LCD 10 of FIG. 5 responds to a picture signal formatted for a smaller number of pixels than 1,024×1,280. The upper and lower blank regions are supposed to be both equivalent to 16 scan lines.

First, as shown in FIG. 14, in a blanking period, a clock signal CLK having a clock period of TL is input to the 257 half -bit scan circuits 14-s and a pulse signal VSTa having a pulse duration of 2×TL is input to the shift circuit 17 from the input terminal 17-1, at shown times in the figure.

The shift circuit 17 shifts the pulse signal VSTa so that the half-bit scan circuits 14-s output as the output signals P-s thereof pulse signals with phases sequentially shifted by a period of TL/2 as shown.

The period TL is set to be substantially equivalent to a scan line selection period T. The clock signal CLK has its level held as it is at a three-clock advanced position, so that output signals P-5 and P-6 of the half-bit scan circuits 14-s are held at a high level.

During this period, high level signals are input as control signals G-1~G-4 of the NAND gate circuits 15-i so as to cover the period in which pulse signals P-1 and P-3 of the half-bit scan circuits 14-s are output as shown. Moreover, as control signals G-5~G-8 of the NAND gate circuits 15-i, high level signals are input to cover the period in which pulse signals P-2 and P-4 of the half-bit scan circuits 14-s are output.

As a result, the vertical drive circuit 12 outputs as output signals GP-1~GP-16 thereof pulse signals having a pulse duration of TL and their phases sequentially shifted by a period of TL/2, at intervals of three scan lines.

During this period, an upper blank region has a black data sequentially written into four lines a time.

After the upper black write period, the clock signal CLK to be input to the half-bit scan circuits 14-s has a clock period thereof modulated to 8×T so that the data shift having been held at scan circuits 14-5 and 14-6 restarts.

As a result, for s≧7, half-bit scan circuits 14-s output pulse signals P-s having a pulse duration of 8×T and their phases sequentially shifted by a period of 4×T.

During this period, pulse signals having a pulse duration of 8×T and their phases sequentially shifted by a period of T are input as the control signals G-1~G-8 of the NAND gate circuits 15-i, at shown times.

As a result, pulse signals having a pulse duration of T, a pulse period of 8×T and their phases sequentially shifted by a period of T are output as signals GP-7~GP-1008 from output buffer circuits 16-i, when an image data is written.

After the image writing period, when a pulse signal is transferred as an output signal P-253 of the half-bit scan circuit 14-253, the clock signal CLK is held at a level, before a clock signal of a clock period of TL is input.

The data shift having been held at scan circuits 14-252 and 14-253 then restarts, causing scan circuits 14-254~14-256 to output as their output signals P-254~P-256 pulse signals having a pulse duration of T and their phases sequentially shifted by a period of TL/2.

During this period, high level signals are input as control signals G-1~G-4 and G-5~G-8 of the NAND gate circuits 15-i, as shown, which provides as output signals GP-1009~GP-1024 of output buffer circuits 16-i pulse signals having a pulse duration of TL and their phases sequentially shifted by a period of TL/2, at intervals of three scan lines.

During this period, a lower blank region has a black data sequentially written into four lines a time.

The four-line writing permits a black data writing to be effected within a period elongated to a 4-fold.

Incidentally, the pixels Px(i, j) of the LCD 10 may comprise a matrix of polycrystalline silicon TFTs integrated on a glass substrate. The peripheral drive circuitry 12–103 may comprise a CMOS static circuit or a CMOS dynamic circuit. The TFTs may be made of an amorphous silicon, Cds, etc. A mono-crystal silicon MOS transistor may be employed.

As will be understood from the foregoing description, according to an embodiment of the present invention, a practical multi-purpose LCD may be implemented with a number of control signal terminals within a reduced range between a ⅗ to a half relative to a conventional case.

Figure 15:
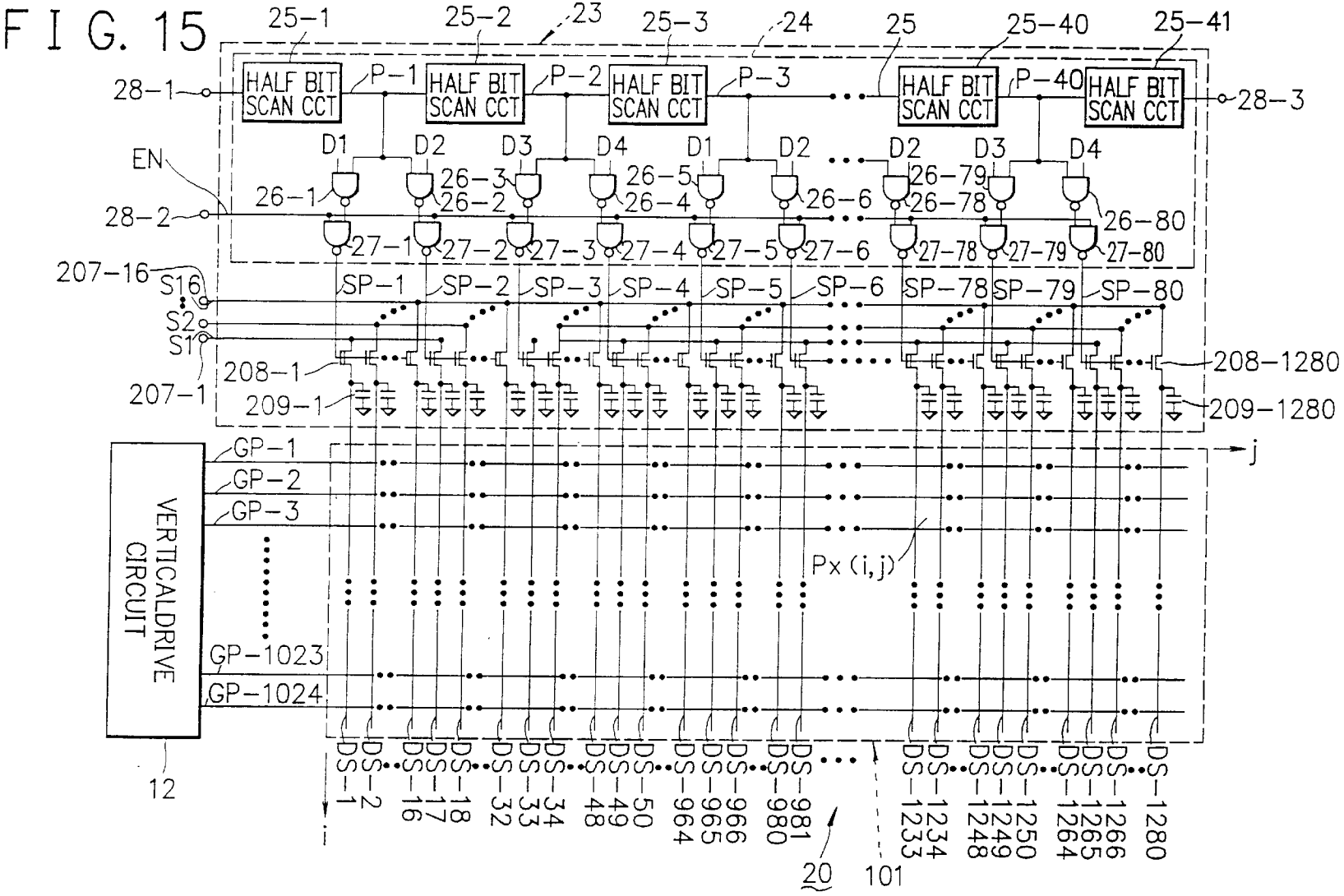
FIG. 15 is a circuit diagram of a multi-purpose LCD with a horizontal drive circuit according to an embodiment of the present invention.

Referring now to FIG. 15, designated at reference character 20 is an LCD according to a preferred embodiment of the present invention. The LCD 20 comprises a liquid crystal display member 101 composed of a back-lighted transparent pixel layer consisting of a matrix of 1,024×1,280 active pixels Px(i, j) cooperatively defining a square display area, and peripheral drive circuitry 12-23 including a vertical drive circuit 12 connected to 1,024 rows of the matrix of pixels Px(i, j) via 1,024 parallel scan lines GP-1~GP-1024 and a horizontal drive circuit 23 connected to 1,280 (=16×80) columns of the matrix of pixels Px(i, j) via 1,280 parallel data lines.

The horizontal drive circuit 23 is composed of a horizontal scan circuit 24, sixteen parallel data bus lines 207-1~207-16 for supplying sixteen multi-phased image data S-1~S-16, respectively, and eighty parallel blocks of data sampling and holding (hereafter "SH") circuits.

Letting p and q be arbitrary integers such that 1≦p≦16 and 1≦q≦80, respectively, a q-th SH circuit block consists of 16 SH circuits of which a p-th one is connected at a data input end thereof to a p-th one 207-p of the 16 data bus lines 207-1~207-16 and at a data output end thereof to a p-th one DS-i (j=16q+p-16) of corresponding 16 data supply lines DS-(16q-15)~DS-16q.

A p-th SH circuit of a q-th circuit block is composed of an SH switch 208-i (j=16q+p-16) as an FET connected at a gate thereof to scan circuit 24, for receiving therefrom a q-th one SP-q of eighty parallel sampling pulses SP-1~SP-80 and at either of a source and a drain thereof to both the input and output ends of the SH circuit, and an SH capacitor 209-i (j=16q+p-16) connected between the data output end of the SH circuit and a grounded common electrode, for holding therein a data S-p sampled from a corresponding data bus line 207-p to be written in vertically scanned pixels Px(i, j) during an image writing period and a black data writing period.

The horizontal scan circuit 24 comprises 41 (=80/2+1) half-bit scan circuits 25-1~25-41, eighty first NAND gate circuits 26-1~26-80, and eighty second NAND gate circuits 27-1~27-80.

The half-bit scan circuits 25-1~25-41 are connected in series therebetween to constitute a pulse signal shift circuit 25. The shift circuit 25 is provided with a first terminal 28-1 for receiving a pulse signal VSTa input thereto as a drive signal for a rightward horizontal scan, and a second terminal 28-3 for receiving a pulse signal VSTb input thereto as a drive signal for a leftward horizontal scan, thus permitting a two-way scan. In the shift circuit 25, the input pulse signal VSTa or VSTb is shifted in either of two directions in synchronism with one of paired dual-phase clock signals CLK (FIGS. 16 and 17), which is selected as a drive signal for the shifting in either direction, so that 40 scan signals P-1~P-40 are available from 40 interconnections between the 41 half-bit scan circuits with a delay equivalent to half a pulse cycle of the selected clock signal CLK. The shift circuit 25 thus selectively employs four drive signals in total.

The 80 first NAND gate circuits 26-q are paired into 40 groups of which a u-th one (u is an arbitrary integer such that 1≦u≦40) has first input terminals of associated first NAND gate circuits 26-q connected to an interconnection between corresponding half-bit scan circuits 25-u and 25-(u+1) to receive therefrom an output signal P-u of one of the half-bit scan circuits 25-u and 25-(u+1). An output terminal of each first NAND gate circuit 26-q is connected to a first input terminal of a corresponding second NAND gate circuit 27-q. Each second NAND gate circuit are connected at a second input terminal thereof to a common supply terminal 28-2 to receive therefrom an enable signal EN as a drive signal, and at an output terminal thereof to the respective gates of corresponding 16 SH switches 208-j.

Letting $u_0$ be u of an arbitrary odd number, every pair of $u_0$-th and $u_0$+1-th ones of the 40 pairs of first NAND gate circuits 26-q includes continuous four 26-($2u_0$−1)~26-2($u_0$+1) of the first NAND gate circuits 26-q, which four circuits 26-($2u_0$−1)~26-($2u_0$+2) have their second input terminals connected in parallel to unshown input terminals of four different drive signals as control signals D-1~D-4 of the first NAND gate circuits 26-q.

Accordingly, a total of drive signals to be input to the horizontal drive circuit 23 does not exceed 9, which is a 9/14 when compared with the conventional LCD 200 in which the number of required control signal terminals for an address decoder amounts to 14 subject to a 16-phased data signal.

In the case of an 8-phased data signal, 16 control signals are required in a conventional case using an address decoder. However, in an LCD according to the embodiment, the number of drive signal terminals for a horizontal drive circuit is held at 9, i.e. a 9/16 to the conventional case. The FIG. 9 will not be increased even when the number of data lines DS-i exceeds 1,280.

In the present embodiment, the pulse signal shift circuit 25 is composed of cascaded 41 half -bit scan circuits 25-u of which outputs P-u are input to 40 pairs of first NAND gate circuits 26-q to drive 80 SH circuits blocks.

In a modification of the embodiment, a pulse signal shift circuit may preferably be composed of cascaded 21-half bit scan circuits of which outputs are input to 20 combinations of four first NAND gate circuits to drive 80 SH circuit blocks.

The present embodiment employs the 80 first NAND gate circuits and the 80 second NAND gate circuits, which may be replaced by 80 first NOR gate circuits and 80 second NOR gate circuits in a modification. In this case, the first NOR gate circuits may receive input signals opposite in logical level to the output signals P-s of the half-bit scan circuits 25-u of the embodiment, the second NOR gate circuits may receive input signals opposite in logical level to enable signals EN, and output buffer circuits may be provided for inverting outputs of the second NOR gate circuits.

Figure 16:
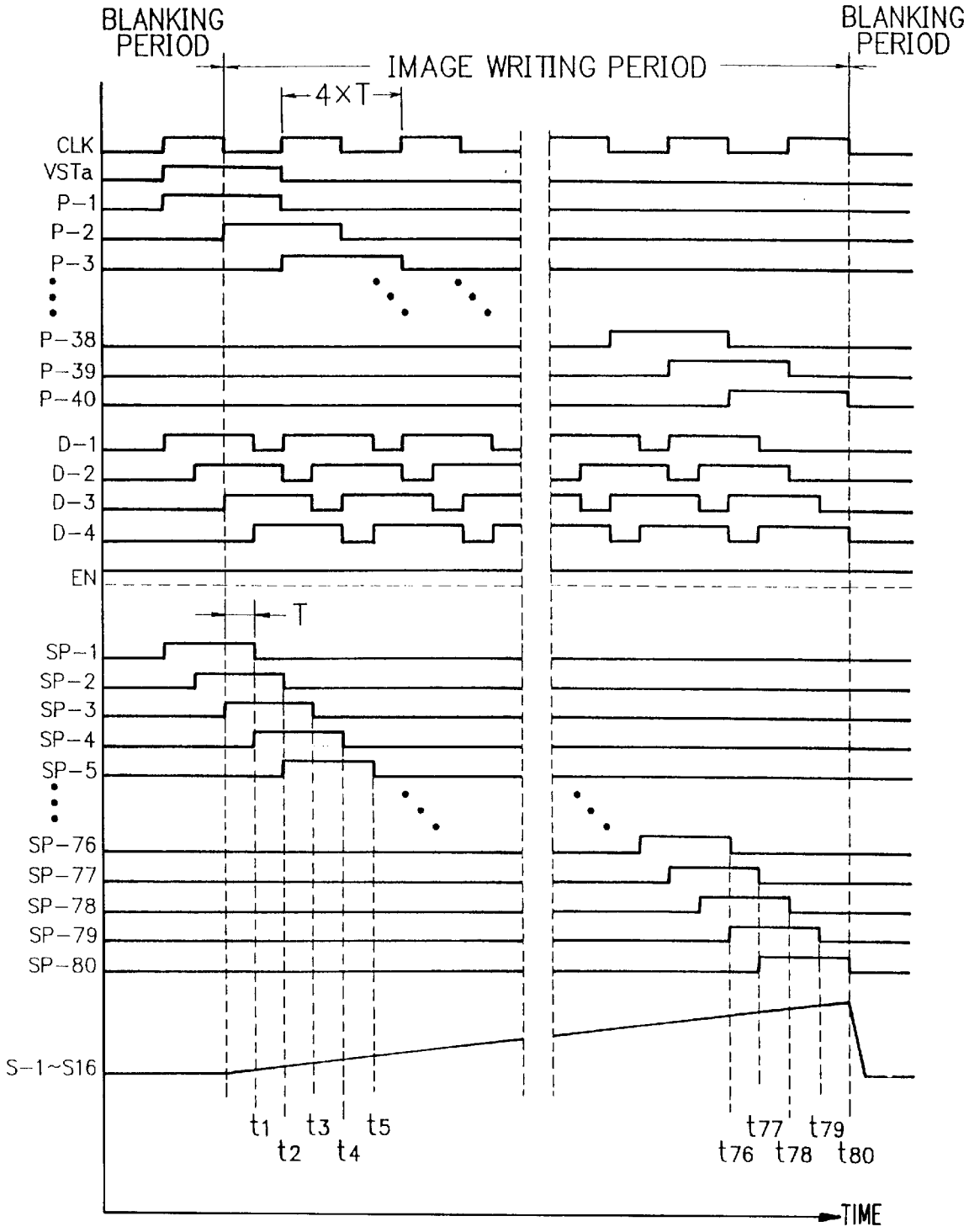
FIG. 16 shows time charts of signals associated with a driving of the LCD of FIG. 15, for a rightward sequential scan with a normal accuracy in accordance with an embodiment of the present invention.

FIG. 16 shows time charts of signals associated with a rightward sequential scan mode of the multi-purpose LCD 20 of FIG. 15.

As shown in FIG. 16, letting T be a sampling period of SH switch, a clock signal CLK having a clock period of 4×T is input to the 41 half -bit scan circuits 25-u and a pulse signal VSTa having a pulse duration of 4×T is input to the shift circuit 25 from the input terminal 28-1, at shown times in the figure. The pulse signal VSTa is sequentially shifted in synchronism with the clock signal CLK, so that 40 half -bit scan circuits 25-1~25-40 output as output signals P-1~P-40 thereof 40 pulse signals having a pulse duration of 4×T and sequentially shifted in phase by a period of 2×T.

The shift circuit 25 adaptive to a driving with a pair of selective dual-phase clock signals may have an external clock signal input thereto with a reverse phase to the above clock signal CLK.

Moreover, as shown in FIG. 16, four pulse signals D-1~D-4 having a pulse duration of 3×T, a pulse period of 4×T and their phases sequentially shifted by a period of T are input as control signals of the 80 first NAND gate circuits 26-q. Further, a signal having a high logical level is input as the enable signal EN for the second NAND gate circuits 27-q.

As a result, the second NAND gate circuits 27-q output as output signals SP-q therefrom 80 sampling pulse signals having a pulse duration of 3×T and their phases sequentially shifted by a period of T.

As the sampling pulses rise at times t1, t2, . . . , t80, the SH switches 208-i sample 16-phase parallel data signals S-p to be written as image data in the data bus lines 207-p.

Like this, there are output signals for a rightward sequential scan mode.

Figure 17:
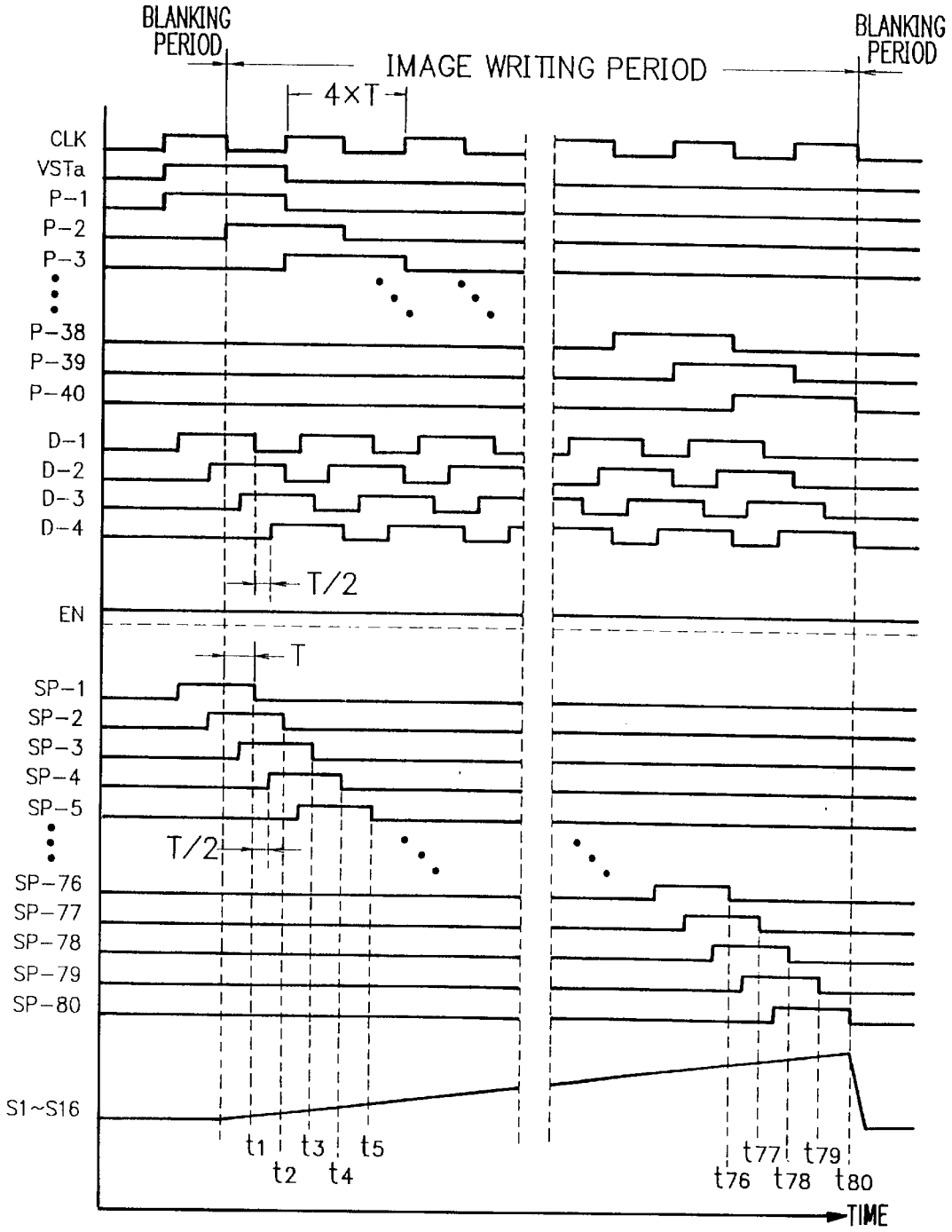
FIG. 17 shows time charts of signals associated with a driving of the LCD of FIG. 15, for a rightward sequential scan with an improved accuracy in accordance with an embodiment of the present invention.

FIG. 17 shows time charts of signals associated with a rightward sequential scan mode of the multi-purpose LCD 20 of FIG. 15, with an improved sampling accuracy.

As shown in FIG. 17, letting T be a sampling period of SH switch, a clock signal CLK having a clock period of 4×T is input to the 41 half -bit scan circuits 25-u and a pulse signal VSTa having a pulse duration of 4×T is input to the shift circuit 25 from the input terminal 28-1, at shown times in the figure. The pulse signal VSTa is sequentially shifted in synchronism with the clock signal CLK, so that 40 half -bit scan circuits 25-1~25-40 output as output signals P-1~P-40 thereof 40 pulse signals having a pulse duration of 4×T and sequentially shifted in phase by a period of 2×T, like the case of FIG. 16.

Moreover, as shown in FIG. 17, four pulse signals D-1~D-4 having a pulse duration of 5/2×T, a pulse period of 4×T and their phases sequentially shifted by a period of T are input as control signals of the 80 first NAND gate circuits 26-q, so that control pulse signal D4 rises with a delay of T/2 from a fall of control pulse signal D1. Further, a signal having a high logical level is input as the enable signal EN for the second NAND gate circuits 27-q.

As a result, the second NAND gate circuits 27-q output as output signals SP-q therefrom 80 sampling pulse signals having a pulse duration of 5/2×T and their phases sequentially shifted by a period of T.

As the sampling pulses rise at times t1, t2, . . . , t80, the SH switches 208-i sample 16-phase parallel data signals S-p to be written as image data in the data bus lines 207-p.

In the case of FIG. 16, a sampling time of image data by one sampling pulse coincides with the time when other sampling pulses rise.

In the case of FIG. 17, when an image signal is sampled, other sampling pulses are inactive.

In general, an image signal tends to have noises when a sampling pulse rises or falls.

Therefore, in the case of FIG. 16 in which a sampling time does not coincide with rise or fall actions of other sampling pulses, a sampled data tends to have noises, thus resulting in an inaccurate sampling.

However, in the case of FIG. 17, a sampling time is shifted from rises or falls of other sampling pulses, so that a sampled data is free of noises due to other sampling pulses, thus resulting in an accurate sampling.

Like this, associated image data are sampled to be written in data bus lines with an improved accuracy.

Figure 18:
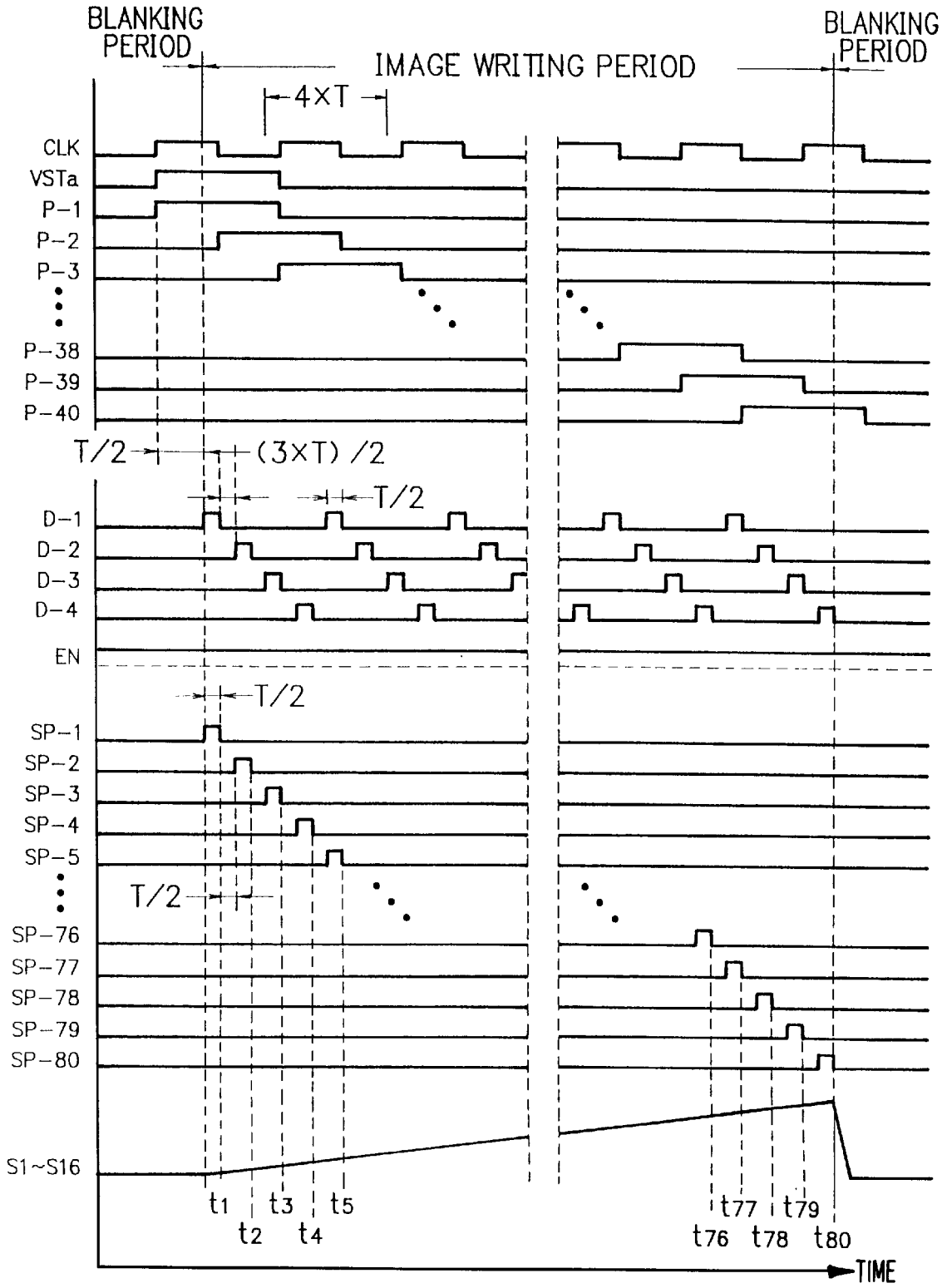
FIG. 18 shows time charts of signals associated with a driving of the LCD of FIG. 15, for a rightward sequential scan with a yet improved accuracy in accordance with an embodiment of the present invention.

FIG. 18 shows time charts of signals associated with a rightward sequential scan mode of the multi-purpose LCD 20 of FIG. 15, with a still improved sampling accuracy.

As shown in FIG. 18, letting T be a sampling period of SH switch, a clock signal CLK having a clock period of 4×T is input to the 41 half -bit scan circuits 25-u and a pulse signal VSTa having a pulse duration of 4×T is input to the shift circuit 25 from the input terminal 28-1, at shown times in the figure. The pulse signal VSTa is sequentially shifted in synchronism with the clock signal CLK, so that 40 half-bit scan circuits 25-1~25-40 output as output signals P-1~P-40 thereof 40 pulse signals having a pulse duration of 4×T and sequentially shifted in phase by a period of 2×T, like the cases of FIGS. 16 and 17.

Moreover, as shown in FIG. 18, four pulse signals D-1~D-4 having a pulse duration of T/2, a pulse period of 4×T and their phases sequentially shifted by a period of T are input as control signals of the 80 first NAND gate circuits 26-q, so that control pulse signal D1 rises with a delay of 3×T/2 from a rise of an output pulse signal P-1 of a half-bit scan circuit 25-1. Further, a signal having a high logical level is input as the enable signal EN for the second NAND gate circuits 27-q.

As a result the second NAND gate circuits 27-q output as output signals SP-q therefrom 80 sampling pulse signals having a pulse duration of T/2 and their phases sequentially shifted by a period of T.

As the sampling pulses rise at times t1, t2, . . . , t80, the SH switches 208-i sample 16-phase parallel data signals S-p to be written as image dat in the data bus lines 207-p.

In the case of FIG. 16, a sampling time of image data by one sampling pulse coincides with the time when other sampling pulses rise.

In the case of FIG. 18, a sampling time is shifted from rises or falls of other sampling pulses, like the case of FIG. 17, thus resulting in an improved sampling relative to the case of FIG. 16.

To this point, in the case of FIG. 17, a triple of neighboring sampling signals are shifted, still in an overlapping manner.

However, in the case of FIG. 18, sampling pulses are not overlapped, whatsoever, so that when an associated SH switch is turned on, a sampled data is quite free from noises due to other sampling pulses, thus permitting a still improved sampling accuracy even to the case of FIG. 17.

In the case of FIG. 18, the duration of a sampling pulse is shorter than a sampling period T. This is an effective driving method if an allowance is left in sampling frequency of an SH switch.

Further, in FIG. 18, control pulse signals D-1~D-4 have their rise and fall actions shifted relative to output pulse signals of half-bit scan circuits that are input to the first NAND gate circuits. Thus, in the embodiment of FIG. 18, noises due to crosstalk and hazard are completely cancelled.

Figure 19:
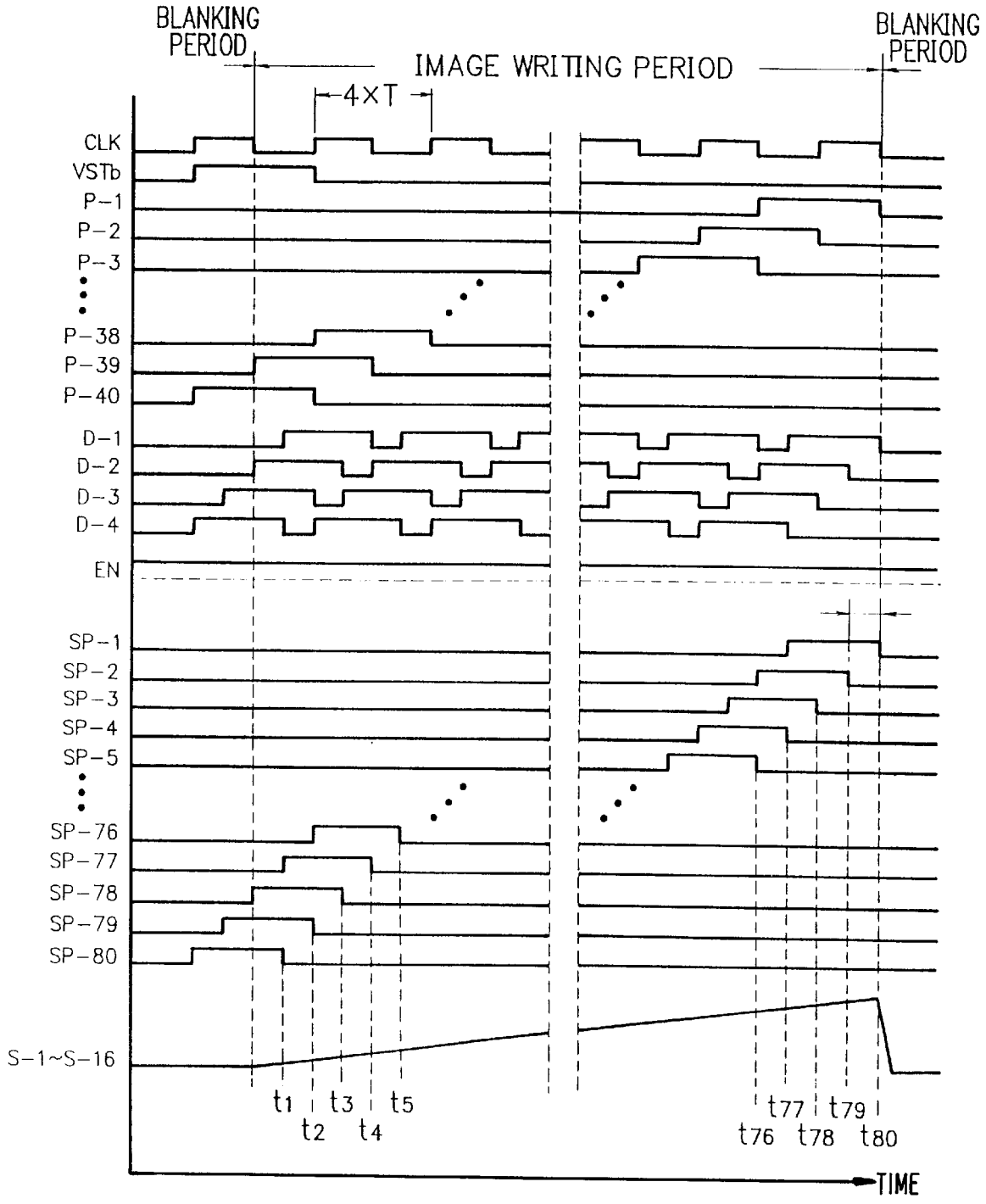
FIG. 19 shows time charts of signals associated with a driving of the LCD of FIG. 15, for a leftward sequential scan in accordance with an embodiment of the present invention.

FIG. 19 shows time charts of signals associated with a leftward sequential scan mode of the multi-purpose LCD 20 of FIG. 15.

As shown in FIG. 19, letting T be a sampling period of SH switch, a clock signal CLK having a clock period of 4×T is input to the 41 half-bit scan circuits 25-u and a pulse signal VSTb having a pulse duration of 4×T is input to the shift circuit 25 from the input terminal 28-3, at shown times in the figure. The pulse signal VSTb is sequentially shifted in a reverse direction to FIG. 16 in synchronism with the clock signal CLK, so that 40 half -bit scan circuits 25-1~2540 output as output signals P-1~P-40 thereof 40 pulse signals having a pulse duration of 4×T and reverse sequentially shifted in phase by a period of 2×T.

The shift circuit 25 adaptive to a driving with a pair of selective dual-phase clock signals may have an external clock signal input thereto with a reverse phase to the above clock signal CLK.

Moreover, as shown in FIG. 19, four pulse signals D-1~D-4 having a pulse duration of 3×T, a pulse period of 4×T and their phases reverse-sequentially shifted by a period of T are input as control signals of the 80 first NAND gate circuits 26-q. Further, a signal having a high logical level is input as the enable signal EN for the second NAND gate circuits 27-q.

As a result, the second NAND gate circuits 27-q output as output signals SP-q therefrom 80 sampling pulse signals having a pulse duration of 3×T and their phases reverse-sequentially shifted by a period of T.

As the sampling pulses rise at times t1, t2, . . . , t80, the SH switches 208-i sample 16-phase parallel data signals S-p to be written as image dat in the data bus lines 207-p.

Like this, there are output signals for a leftward sequential scan mode.

Figure 20:
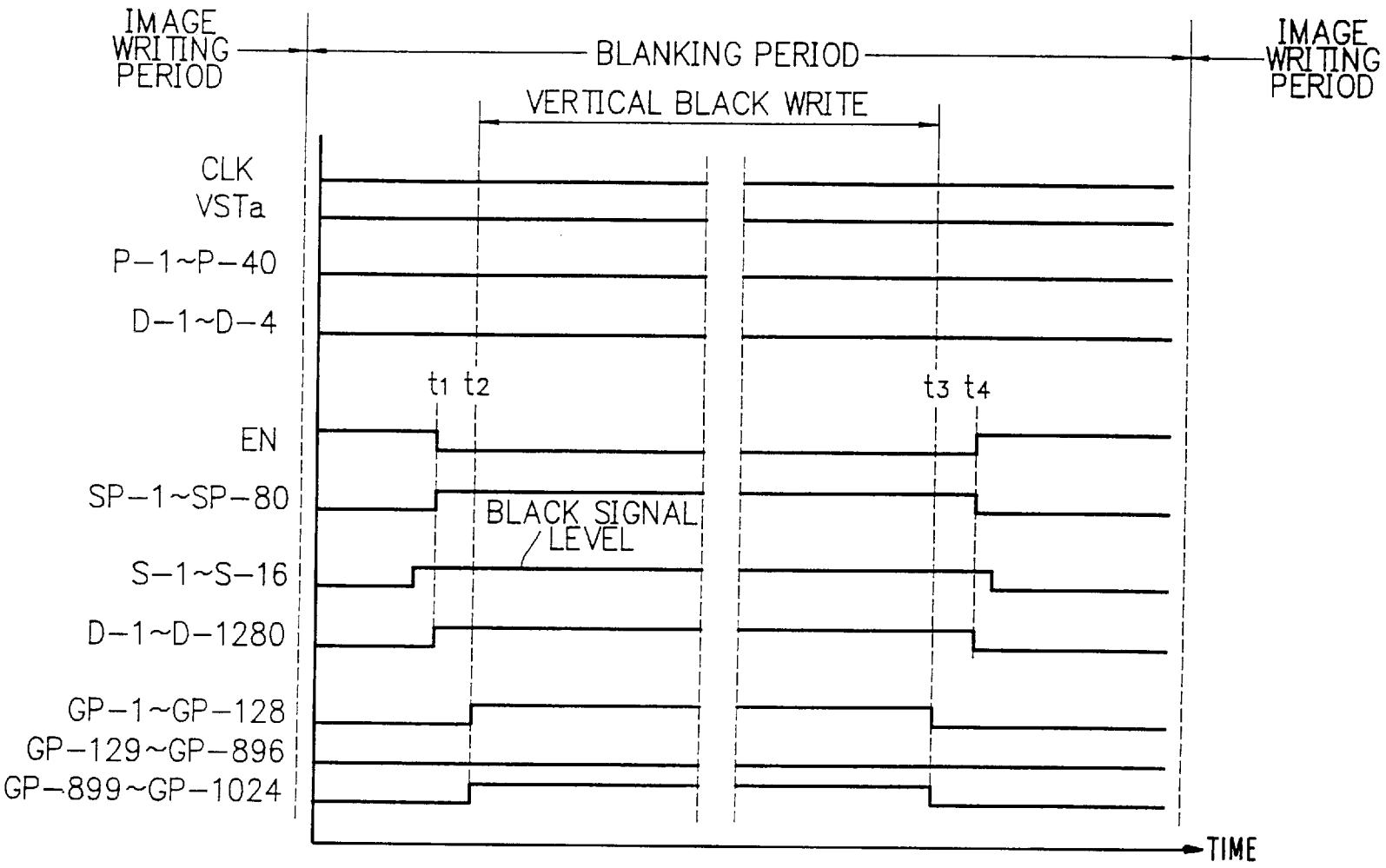
FIG. 20 shows time charts of signals associated with a driving of the LCD of FIG. 15, for writing a black data in upper and lower blank regions in accordance with an embodiment of the present invention.

FIG. 20 shows time charts of signals associated with a driving for writing a black data in upper and lower blank regions of a display area, when the multi-purpose LCD 20 of FIG. 15 responds to a picture signal formatted for a smaller number of pixels than 1,024×1,280. The upper and lower blank regions are both supposed to correspond to 128 scan lines.

First, as shown in FIG. 20, in a vertical blanking period, the clock signal CLK to be input to the 41 half -bit scan circuits 25-1~25-41 and the signal VSTa to be input from the terminal 28-1 are set to a low level. The scan circuits 25-1~25-41 are supposed to have no data left therein, i.e. all data have been swept out, so that their output signals P-u have a low level as shown.

Under such the condition, pulse signals having a low logical level are input as control signals D-1~D-4 of the first NAND gate circuits 26-q.

At a shown time t1, the enable signal EN to the second NAND gate circuits 27-q is changed from a high logical level to a low logical level.

Thereafter, at a time t4, the enable signal EN is changed from the low level to the high level.

During the interval between t1 and t4, high logical level signals are output as the output signals SP-q of the second NAND gate circuits 27-q so that all the SH switches 208-j are turned on between t1 and t4.

On the other hand, in an interval between t2 and t3, gate pulse signals GP-1~GP-128 and GP-899~GP-1024 of the scan lines corresponding to the upper and lower blank regions to be displayed in black are set to a high level. Further, a black color data is input.

By such a driving, 1,280 SH switches 208-j, as well as respective pixel switches on upper and lower 128 scan lines, are all turned on, between t2 and t3, so that the black data then input is written in respective pixels Px(i, j) on the 256 (=128×2) scan lines, which are thus black-displayed. The interval between t2 and t3 is set to be long enough to complete the writing to the 256 lines.

Like this, a vertical black writing is effected during a vertical blanking period.

Figure 21:
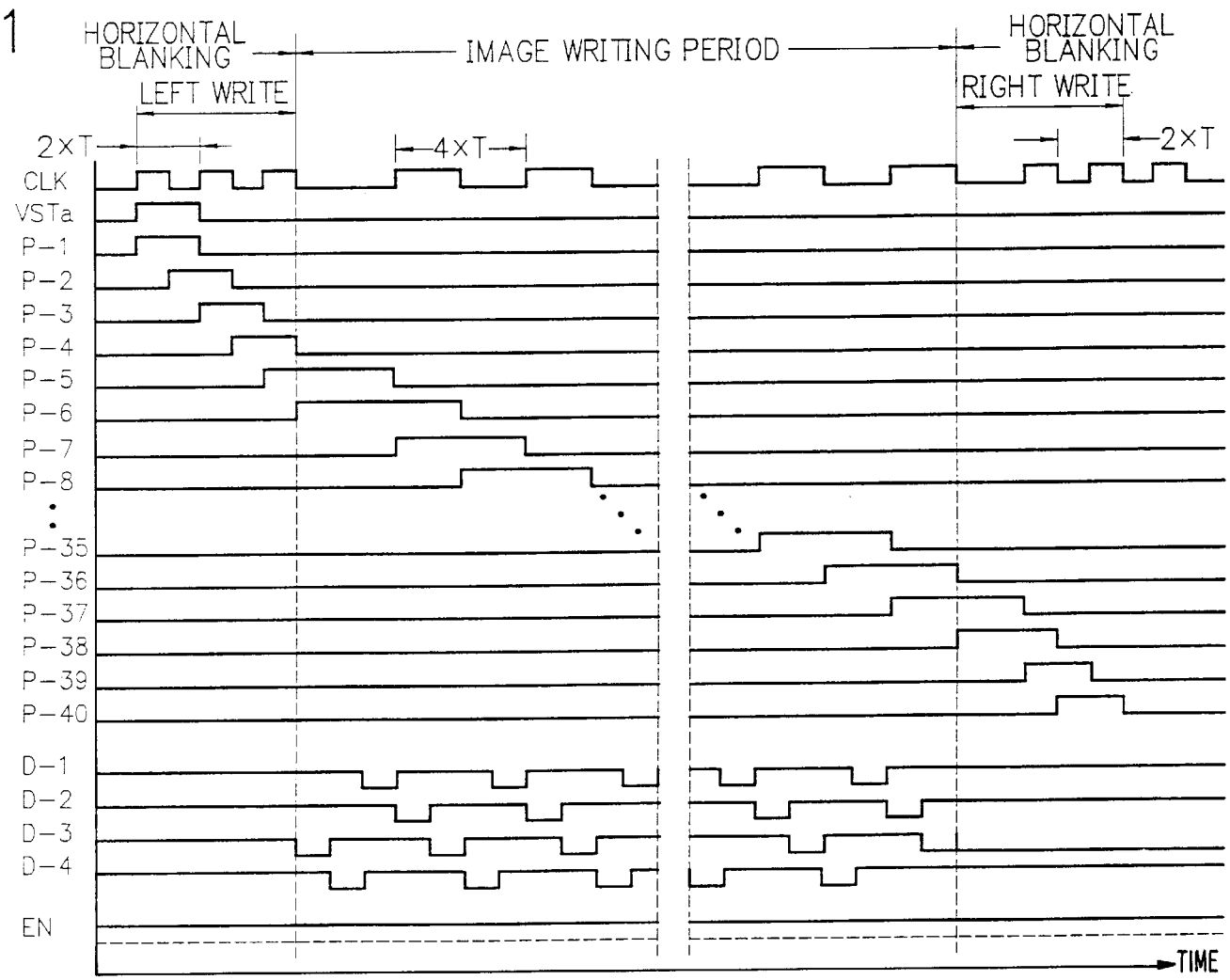
FIGS. 21 and 22 cooperatively show time charts of signals associated with a driving of the LCD of FIG. 15, for writing a black data in left and right blank regions in accordance with an embodiment of the present invention.
Figure 22:
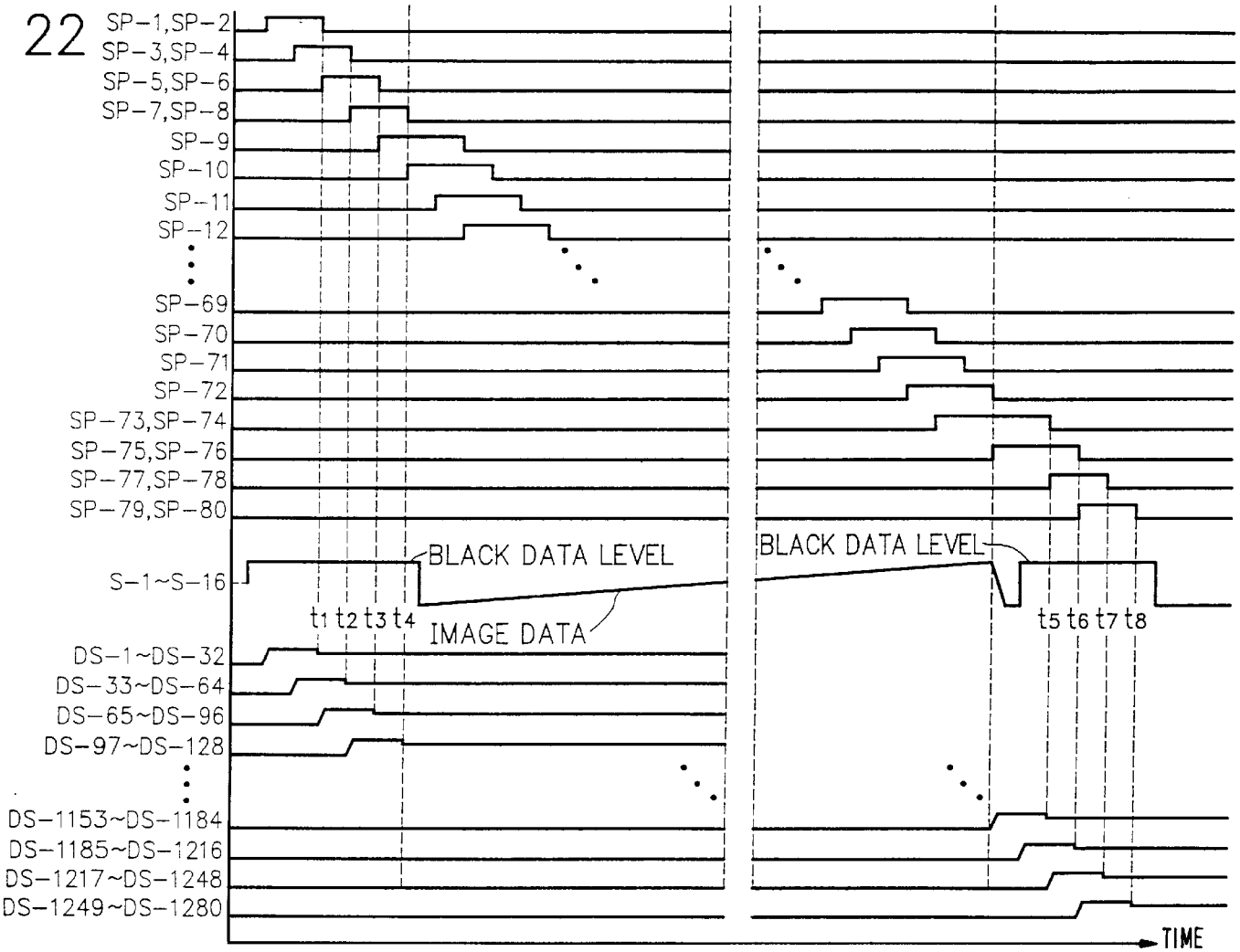

FIGS. 21 and 22 cooperatively show time charts of signals associated with a driving for writing a black data in left and right blank regions of a display area, when the multi-purpose LCD 20 of FIG. 15 responds to a picture signal formatted for a smaller number of pixels than 1,024×1,280. The left and right blank regions are supposed to be both equivalent to 128 data lines.

First, as shown, in a horizontal blanking period, letting T be a sampling period of SH switch, a clock signal CLK having a clock period of 2×T is input to the 41 half-bit scan circuits 25-u and a pulse signal VSTa having a pulse duration of 2×T is input to the shift circuit 25 from the input terminal 28-1, at shown times in FIG. 21. The pulse signal VSTa is sequentially shifted in synchronism with the clock signal CLK, so that 40 half -bit scan circuits 25-1~25-40 output as output signals P-1~P-40 thereof 40 pulse signals having a pulse duration of 2×T and sequentially shifted in phase by a period of T.

The shift circuit 25 adaptive to a driving with a pair of selective dual-phase clock signals may have an external clock signal input thereto with a reverse phase to the above clock signal CLK.

Moreover, as shown in FIG. 21, four high logical level pulse signals are input as control signals D-1~D-4 of the 80 first NAND gate circuits 26-q. Further, a signal having a high logical level is input as the enable signal EN for the second NAND gate circuits 27-q.

As a result, the second NAND gate circuits 27-q output as output signals SP-q therefrom 80 sampling pulse signals having a pulse duration of 2×T and their phases sequentially shifted by a period of T.

During the horizontal blanking period, a black display signal level is input as image data S-1~S-16, so that pairs of sampling pulse signals SP-1 and SP-2, SP-3 and SP-4, SP-5 and SP-6 and SP-7 and SP-8 rise and, at times t1, t2, t3 and t4, a black display signal is sampled and sequentially written in data lines DS-1~DS-32, DS-33~DS-64, DS-65~DS-96 and DS-97~DS-128.

Like this, pixels on the left 128 data lines are black-displayed in the horizontal blanking period.

In an image writing period following the horizontal blanking period, like driving to the case of FIG. 16 is performed. First, the period of clock signal CLK is modulated from 2×T to 4×T, which provides as output signals P-u of the half-bit scan circuits 25-u pulse signals having a duration of 4×T and phases sequentially shifted by a period of 2×T. Pulse signal P-6 has a duration of 5×T, which is not issue to the circuit action in concern.

On the other hand, four pulse signals having a duration of 3×T, a period of 4×T and phases sequentially shifted by a period of T are input as control signals D-1~D-4 of the 80 first NAND gate circuits 26-q, in a shown timing. Further, a signal having a high logical level is input as the enable signal EN for the second NAND gate circuits 27-q.

As a result, the second NAND gate circuits 27-q output as output signals SP-9~SP-72 thereof sampling pulse signals having a pulse duration of 3×T and their phases sequentially shifted by a period of T.

The sampling pulse signals selects corresponding SH switches 208-j, which samples 16-phase parallel image data S-p when the sampling pulses rise. The sampled data are written in data bus line DS-129~DS-1152.

The image data writing period is followed by a subsequent horizontal blanking period, in which a black data is written in pixels Px(i, j) in right 128 columns, i.e. pixels Px(i, j) connected to right 128 data lines.

In this blanking period, first, the clock signal CLK for half-bit scan circuits 25-u is modulated from the period of 4×T to a period of 2×T, so that half-bit scan circuit 25-37~25-40 output as their output signals P-37~P-40 pulse signals having a duration of 2×T and phases sequentially shifted by a period T. Pulse signals P-37 and P-38 have a duration of 4×T and a duration of 3×T, respectively, which are not issues to the circuit action in concern.

Moreover, as control signals D-1~D-4 of the 80 first NAND gate circuits 26-q, there are input signals having a high logical level. Further, a signal having a high logical level is input as the enable signal EN to the second NAND gate circuits 27-q.

As a result, the second NAND gate circuits 27-q output as output signals SP-q thereof sampling pulse signals having a pulse duration of 2×T and their phases sequentially shifted by a period of T every other. Paired sampling pulse signals SP-73 and SP-74, and SP-75 and SP-76 have pulse durations of 4×T and 3×T, respectively.

In this horizontal blanking period, a black display signal level is input as image data S-p. As paired sampling pulse signals SP-73 and SP-74, SP-75 and SP-76, SP-77 and SP-78 and SP-79 and SP-80 rise at times t5, t6, t7 and t8, there are sampled the black display data, which are sequentially written in data bus lines DS-1153~DS-1184, DS-1185~DS-1216, DS-1217~DS-1248, DS-1249~DS-1280.

Like this, pixels on the right 128 data lines are black-displayed in the horizontal blanking period.

As a result, left and right blanks are displayed in black.

Figure 23:
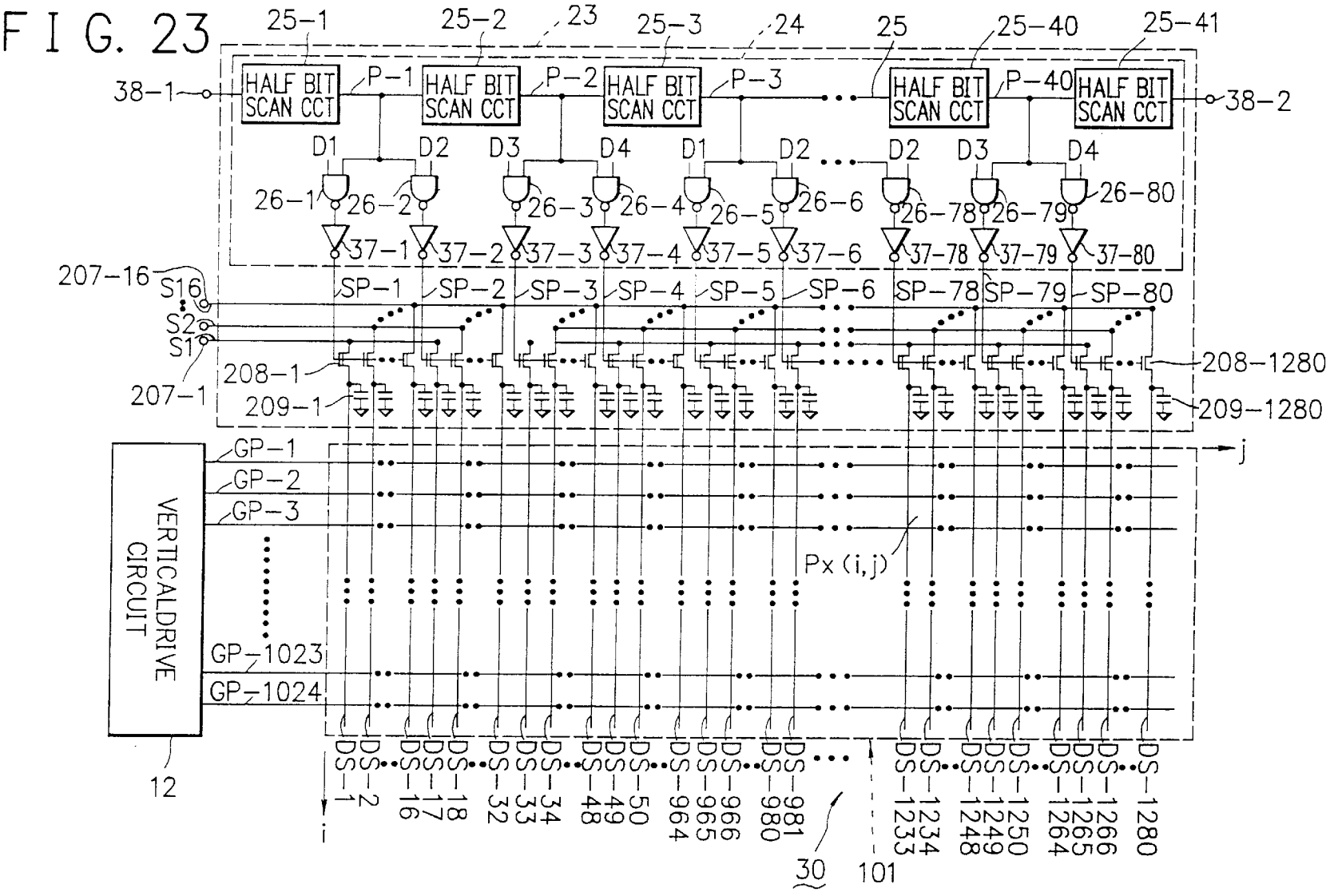
FIG. 23 is a circuit diagram of a multi-purpose LCD with a modified horizontal drive circuit according to an embodiment of the present invention.

Referring now to FIG. 23, designated at reference character 30 is an LCD according to a preferred embodiment of the present invention. Like the LCD 20, the LCD 30 comprises a liquid crystal display member 101 composed of a back-lighted transparent pixel layer consisting of a matrix of 1,024×1,280 active pixels Px(i, j) cooperatively defining a square display area, and peripheral drive circuitry 12-23 including a vertical drive circuit 12 connected to 1,024 rows of the matrix of pixels Px(i, j) via 1,024 parallel scan lines GP-1~GP-1024 and a horizontal drive circuit 23 connected to 1,280 columns of the matrix of pixels Px(i, j) via 1,280 parallel data lines.

The horizontal drive circuit 23 is composed of a horizontal scan circuit 24, sixteen parallel data bus lines 207-1~207-16 for supplying sixteen multi-phased parallel image data S-1~S-16, respectively, and eighty parallel blocks of SH circuits, like in LCD 20.

A q-th SH circuit block consists of 16 SH circuits of which a p-th one is connected at a data input end thereof to a p-th one 207-p of the 16 data bus lines 207-1~207-16 and at a data output end thereof to a p-th one DS-i (j=16q+p-16) of corresponding 16 data supply lines DS-(16q-15)~DS-16q, and a p-th SH circuit of a q-th circuit block is composed of an SH switch 208-j (j=16q+p-16) and an SH capacitor 209-j (j=16q+p-16), like in LCD 20.

The horizontal scan circuit 24 comprises 41 half -bit scan circuits 25-1~25-41, eighty NAND gate circuits 26-1~26-80, and eighty output buffer circuits 37-1~37-80.

The half-bit scan circuits 25-1~25-41 are connected in series therebetween to constitute a pulse signal shift circuit 25. The shift circuit 25 is provided with a first terminal 38-1 for receiving a pulse signal VSTa input thereto as a drive signal for a rightward horizontal scan, and a second terminal 38-2 for receiving a pulse signal input thereto as a drive signal for a leftward horizontal scan, thus permitting a two-way scan. In the shift circuit 25, the input pulse signal is shifted in synchronism with one of paired dual-phase input clock signals CLK, which is selected as a drive signal for the shifting in either direction, so that 40 scan signals P-1~P-40 are available with a delay equivalent to half a pulse cycle of the selected clock signal CLK. The shift circuit 25 thus selectively employs four drive signals in total.

The 80 NAND gate circuits 26-q are paired into 40 groups of which a u-th one has first input terminals of associated NAND gate circuits 26-q connected to an interconnection between corresponding half-bit scan circuits 25-u and 25-(u+1) to receive therefrom an output signal P-u of one of the half-bit scan circuits 25-u and 25-(u+1). An output terminal of each NAND gate circuit 26-q is connected to an input terminal of a corresponding output buffer circuit 37-q as an inverter of which an output terminal is connected respective gates of corresponding 16 SH switches 208-j.

Letting $u_0$ be u of an arbitrary odd number, every pair of $u_0$-th and $u_0$+1-th ones of the 40 pairs of NAND gate circuits 26-q includes continuous four 26-($2u_0-1$)~26-2($u_0$+1) of the NAND gate circuits 26-q, which four circuits 26-($2u_0-1$)~26-($2u_0$+2) have their second input terminals connected in parallel to unshown input terminals of four different drive signals as control signals D-1~D-4 of the NAND gate circuits 26-q.

Accordingly, a total of drive signals to be input to the horizontal drive circuit 23 does not exceed 8, which is a 4/7 when compared with the conventional LCD 200 in which the number of required control signal terminals for an address decoder amounts to 14 subject to a 16-phased data signal.

In the case of an 8-phased data signal, 16 control signals are required in a conventional case using an address decoder. However, in an LCD according to the embodiment, the number of drive signal terminals for a horizontal drive circuit is held at 8, i.e. a ½ to the conventional case. The FIG. 8 will not be increased even when the number of data lines DS-j exceeds 1,280.

In the present embodiment, the pulse signal shift circuit 25 is composed of cascaded 41 half -bit scan circuits 25-u of which outputs P-u are input to 40 pairs of NAND gate circuits 26-q to drive 80 SH circuits blocks.

In a modification of the embodiment, a pulse signal shift circuit may preferably be composed of cascaded 21 half bit scan circuits of which outputs are input to 20 combinations of four NAND gate circuits to drive 80 SH circuit blocks.

The present embodiment employs the 80 NAND gate circuits 26-q, which may be replaced by 80 NOR gate circuits in a modification. In this case, the NOR gate circuits may receive input signals opposite in logical level to the output signals P-s of the half-bit scan circuits 25-u of the embodiment, and the inverting output buffer circuits 37-q of the embodiment may be replaced by non-inverting output buffer circuits.

Figure 24:
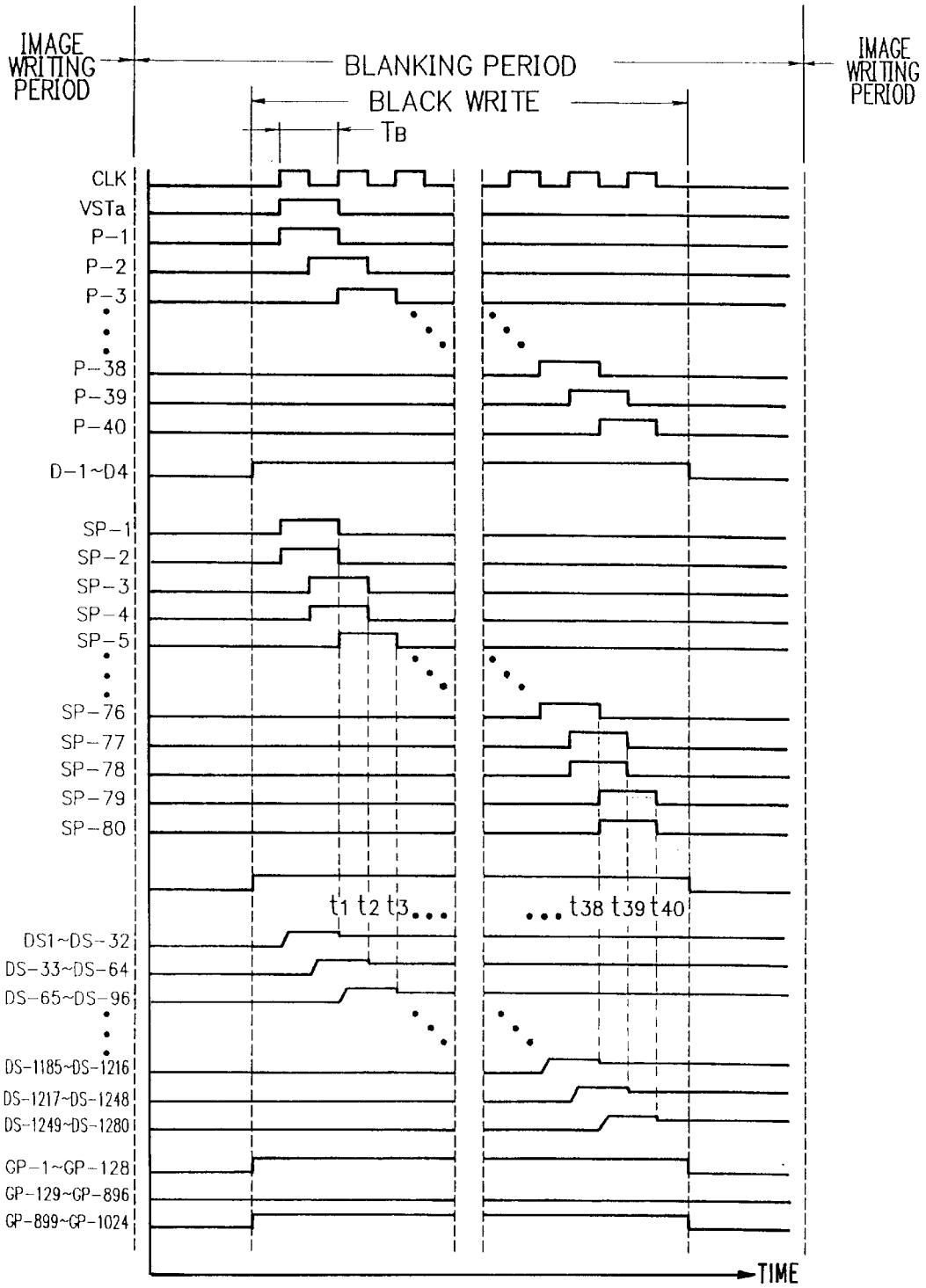
FIG. 24 shows time charts of signals associated with a driving of the LCD of FIG. 23, for writing a black data in upper and lower blank regions in accordance with an embodiment of the present invention.

FIG. 24 shows time charts of signals associated with a driving for writing a black data in upper and lower blank regions of a display area, when the multi-purpose LCD 30 of FIG. 23 responds to a picture signal formatted for a smaller number of pixels than 1,024×1,280. The upper and lower blank regions are both supposed to correspond to 128 scan lines.

First, in a vertical blanking period, the clock signal CLK with a preset period TB is input to the 41 half-bit scan circuits 25-1~25-41, and the pulse signal VSTa with a duration of TB is input in a shown timing from the terminal 38-1 to the shift circuit 25, where it is sequentially shifted in synchronism with the clock signal CLK, so that the half-bit scan circuits 25-1~25-40 output as output signals P-1~P40 thereof pulse signals having a pulse duration of TB and their phases sequentially shifted by a period of TB/2.

The shift circuit 25 adaptive to a driving with a pair of selective dual-phase clock signals may have an external clock signal input thereto with a reverse phase to the above clock signal CLK.

On the other hand, signals with a high logical level are input as control signals D-1~D-4 to the NAND gate circuits 26-q.

As a result, the output buffer circuits 37-1~37-80 output as output signals SP-q thereof sampling pulse signals having a pulse duration of TB and their phases sequentially shifted each other by a period of TB/2.

In the vertical blanking period, a multi-phased signal with a black display level is input as image data S-p. As paired sampling pulse signals SP-1 and SP-2, SP-3 and SP-4, SP-5 and SP-6, . . . , SP-79 and SP-80 rise at times t1, t2, t3, . . . , t40, there are sampled the black display data, which are sequentially written in data bus lines DS-1~DS-32, DS-33~DS-64, DS-65~DS-96, . . . , DS-1249~DS-1280.

As gate pulse signals GP-1~GP-128 and GP-899~GP-1024 on scan lines of the upper and lower blank region are set to a high logical level, the sampled black display data are written from the data bus lines DS-j to pixels Px(i, j) in the upper and lower blank region.

Like this, the upper and lower blank regions are black-displayed in the vertical blanking period.

In the embodiment, the pulse signal input in the shift circuit 25 has a preset duration of TB, which may be modified to a duration of L×TB, where L is a positive integer larger than unit.

In this modification, sampling pulses output from the buffer circuits 37-q have a duration of L×TB, which provides an elongated writing period for writing a black display data in data bus lines.

The driving of FIG. 24 may be applied to the LCD 20 of FIG. 15. In this case, a pulse signal with a high logical level may be employed as the enable signal EN to be applied to the second NAND gate circuits 27-q.

Incidentally, the pixels Px(i, j) of the LCDs 20 and 30 may comprise a matrix of polycrystalline silicon TFTs integrated on a glass substrate. The peripheral drive circuitry 12-23 may comprise a CMOS static circuit or a CMOS active circuit. The TFTs may be made of an amorphous silicon, CdS, etc. A mono-crystal silicon MOS transistor may be employed.

As will be understood from the foregoing description, according to an embodiment of the present invention, a practical multi-purpose LCD may be implemented with a number of control signal terminals within a reduced range between a 9/14 to a half relative to a conventional case.

Such an effect may be remarkable with an increased number of pixels and/or a reduced number of image data multiplying phases.

Moreover, a complete cancellation of noises due to crosstalk permits a stable display service.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A liquid crystal display comprising:

an active matrix array having switching elements thereof arranged at cross points between scan lines and data lines;

a vertical drive circuit for driving the scan lines; and a horizontal drive circuit for driving the data lines;

the vertical drive circuit comprising:

an N-staged scan circuit for providing N outputs of a pulse signal sequentially shifted by half a period of a clock signal, where N is a positive integer, N×M logic gate circuits having first control terminals of combinations of M logic gate circuits thereof common connected therebetween, respectively of those combinations, to be connected to N output terminals of the scan circuit, respectively, where M is an integer larger than unity, and second control terminals of combinations of logic gate circuits at intervals of 2×M−1 thereof common connected therebetween, respectively of these combinations, and output buffer circuits having output signals of the logic gate circuits as input signals thereto.

2. A liquid crystal display according to claim 1, wherein the logic gate circuits each respectively comprise a 2-input NAND circuit.

3. A liquid crystal display according to claim 1, wherein the scan circuit comprises circuit means for shifting the pulse signal in a two-way mode.

4. A liquid crystal display according to claim 1, wherein the integer M is larger than three.

5. A liquid crystal display comprising:

an active matrix array having switching elements thereof arranged at cross points between scan lines and data lines;

a vertical drive circuit for driving the scan lines; and a horizontal drive circuit for driving the data lines;

the horizontal drive circuit comprising:

an N-staged scan circuit for providing N outputs of a pulse signal sequentially shifted by half a period of a clock signal, where N is a positive integer, N×M first logic gate circuits having first control terminals of combinations of M first logic gate circuits thereof common connected therebetween, respectively of those combinations, to be connected to N output terminals of the scan circuit, respectively, where M is an integer larger than unity, and second control terminals of combinations of first logic gate circuits at intervals of 2×M−1 thereof common connected therebetween, respectively of these combinations, N×M second logic gate circuits having first control terminals thereof connected to output terminals of the first logic gate circuits and second control terminals thereof common connected therebetween, and N×M data sampling and holding switches having control terminals of combinations of J data sampling and holding switches thereof common connected therebetween, respectively of these combinations, to be connected to output terminals of the second logic gate circuits, respectively, where J is a positive integer, and input terminals of combinations of data sampling and holding switches at intervals of J−1 thereof common connected therebetween, respectively of these combinations.

6. A liquid crystal display according to claim 5, wherein the first and second logic gate circuits each respectively comprise a 2-input NAND circuit.

7. A liquid crystal display according to claim 5, wherein the scan circuit comprises circuit means for shifting the pulse signal in a two-way mode.

8. A liquid crystal display comprising:

an active matrix array having switching elements thereof arranged at cross points between scan lines and data lines;

a vertical drive circuit for driving the scan lines; and a horizontal drive circuit for driving the data lines;

the horizontal drive circuit comprising:

an N-staged scan circuit for providing N outputs of a pulse signal sequentially shifted by half a period of a clock signal, where N is a positive integer, N×M logic gate circuits having first control terminals of combinations of M logic gate circuits thereof common connected therebetween, respectively of those combinations, to be connected to N output terminals of the scan circuit, respectively, where M is an integer larger than unity, and second control terminals of combinations of logic gate circuits at intervals of 2×M−1 thereof common connected therebetween, respectively of these combinations, output buffer circuits for inputting output signals of the logic gate circuits, and N×M data sampling and holding switches having control terminals of combinations of J data sampling and holding switches thereof common connected therebetween, respectively of these combinations, to be connected to output terminals of the output buffer circuits, respectively, where J is a positive integer, and input terminals of combinations of data sampling and holding switches at intervals of J−1 thereof common connected therebetween, respectively of these combinations.

9. A driving method for driving a liquid crystal display including an active matrix array having switching elements thereof arranged at cross points between scan lines and data lines, a vertical drive circuit for driving the scan lines, and a horizontal drive circuit for driving the data lines, the driving method comprising the steps of:

providing in the vertical drive circuit an N-staged scan circuit for providing N outputs of a pulse signal sequentially shifted by half a period of a clock signal, where N is a positive integer;

providing in the vertical drive circuit N×M logic gate circuits having first control terminals of combinations of M logic gate circuits thereof common connected therebetween, respectively of those combinations, to be connected to N output terminals of the scan circuit, respectively, where M is an integer larger than unity, and second control terminals of combinations of logic gate circuits at intervals of 2×M−1 thereof common connected therebetween, respectively of these combinations; and providing in the vertical drive circuit output buffer circuits having output signals of the logic gate circuits as input signals thereto.

10. A driving method according to claim 9, further comprising the steps of:

inputting a clock signal having a period of 2×M×T to the scan circuit, where T is a scan line selection interval;

sequentially inputting 2×M different pulse signals A-1, A-2, . . . , A-(2×M) to 2×M second control terminals G-1, G-2, . . . , G-(2×M) of the N×M logic gate circuits, the 2×M pulse signals having a pulse duration of T, a pulse period of 2×M×T and phases sequentially shifted by a period of T; and inputting the 2×M pulse signals for a driving in a timing meeting a relationship such that:

$$0<(t\mathbf{1}-t\mathbf{0})<\{(2\times M\times T)/2\},$$

where t0 is a time when a logical level of a K-th output signal of the scan circuit is changed, where K is a positive integer, and t1 is a time after the time t0, when a logical level of a pulse signal to be input to a second control terminal of a {1+M×(K−1)}-th logic gate circuit is changed.

11. A driving method according to claim 9, further comprising the steps of:

inputting a clock signal having a period of 2×M×T to the scan circuit, where T is a scan line selection interval;

inputting 2×M different pulse signals A-1, A-2, . . . , A-(2×M) in an reverse order to 2×M second control terminals G-1, G-2, . . . , G-(2×M) of the N×M logic gate circuits, the 2×M pulse signals having a pulse duration of T, a pulse period of 2×M×T and phases sequentially shifted by a period of T; and inputting the 2×M pulse signals for a driving in a timing meeting a relationship such that:

$$0<(t1-t0)<\{(2\times M\times T)/2\},$$

where t0 is a time when a logical level of a K-th output signal of the scan circuit is changed, where K is a positive integer, and t1 is a time after the time t0, when a logical level of a pulse signal to be input to a second control terminal of an (M×K)-th logic gate circuit is changed.

12. A driving method according to claim 9, further comprising the steps of:

inputting a clock signal having a period of M×T to the scan circuit, where T is a scan line selection interval;

sequentially inputting M different pulse signals A-1, A-2, . . . , A-M to combinations of 2×M second control terminals G-1 and G-2, G-3 and G-4, . . . , G-(2×M−1) and G-(2×M) of the N×M logic gate circuits, the M pulse signals having a pulse duration of T, a pulse period of M×T and phases sequentially shifted by a period of T; and inputting the M pulse signals for a driving in a timing meeting a relationship such that:

$$0<(t1-t0)<\{(M\times T)/2\},$$

where t0 is a time when a logical level of a K-th output signal of the scan circuit is changed, where K is a positive integer, and t1 is a time after the time t0, when a logical level of a pulse signal to be input to a second control terminal of a {1+M×(K−1)}-th logic gate circuit is changed.

13. A driving method according to claim 9, further comprising the steps of:

inputting a clock signal having a period of M×T/2 to the scan circuit, where T is a scan line selection interval;

sequentially inputting M/2 different pulse signals A-1, A-2, . . . , A-M/2 to combinations of 2×M second control terminals G-1~G-4, G-5~G-8, . . . , G-(2×M−3)~G-(2×M) of the N×M logic gate circuits, the M/2 pulse signals having a pulse duration of T, a pulse period of M×T/2 and phases sequentially shifted by a period of T; and inputting the M/2 pulse signals for a driving in a timing meeting a relationship such that:

$$0<(t1-t0)<\{(M\times T)/4\},$$

where t0 is a time when a logical level of a K-th output signal of the scan circuit is changed, where K is a positive integer, and t1 is a time after the time t0, when a logical level of a pulse signal to be input to a second control terminal of a {1+M×(K−1)}-th logic gate circuit is changed.

14. A driving method according to claim 9, further comprising the steps of:

inputting a clock signal having a period of M×T to the scan circuit, where T is a scan line selection interval;

executing, in an odd-number field:

sequentially inputting M different pulse signals A-1, A-2, . . . , A-M to second control terminals G-1, G-3, G-5, . . . , G-(2×M−1) of odd-number ordered ones of the N×M logic gate circuits, the M pulse signals having a pulse duration of T, a pulse period of M×T and phases sequentially shifted by a period of T, and inputting the M pulse signals for a driving in a timing meeting a relationship such that:

$$0<(t1-t0)<\{(M\times T)/2\},$$

where t0 is a time when a logical level of a K-th output signal of the scan circuit is changed, where K is a positive integer, and t1 is a time after the time t0, when a logical level of a pulse signal to be input to a second control terminal of a {1+M×(K−1)}-th logic gate circuit is changed; and executing, in an even-number field:

sequentially inputting M different pulse signals A-1, A-2, . . . , A-M to second control terminals G-2, G-4, G-6, . . . , G-(2×M) of even-number ordered ones of the N×M logic gate circuits, the M pulse signals having a pulse duration of T, a pulse period of M×T and phases sequentially shifted by a period of T, and inputting the M pulse signals for a driving in a timing meeting a relationship such that:

$$0<(t1-t0)<\{(M\times T)/2\},$$

where t0 is a time when a logical level of a K-th output signal of the scan circuit is changed, where K is a positive integer, and t1 is a time after the time t0, when a logical level of a pulse signal to be input to a second control terminal of a {2+M×(K−1)}-th logic gate circuit is changed.

15. A driving method according to claim 9, further comprising the steps of:

inputting to the scan circuit a clock signal having a clock period thereof modulatable from 2×M×T to {(2×M-J)×T}, where T is a scan line selection interval and J is a positive integer not exceeding M;

sequentially inputting 2×M different pulse signals A-1, A-2, . . . , A-(2×M) to 2×M second control terminals G-1, G-2, . . . , G-(2×M) of the N×M logic gate circuits, the 2×M pulse signals having a pulse duration of T and phases sequentially shifted by a period of T when the clock period is 2×M×T, excepting J points when the clock period is {(2×M-J)×T}; and inputting the 2×M pulse signals for a driving in a timing meeting a relationship such that:

$$0<(t1-t0)<\{(2\times M\times T)/2\},$$

where t0 is a time when a logical level of a K-th output signal of the scan circuit is changed, where K is a positive integer, and t1 is a time after the time t0, when a logical level of a pulse signal to be input to a second control terminal of a {1+M×(K−1)}-th logic gate circuit is changed.

16. A driving method according to claim 9, wherein the liquid crystal display has a blanking period comprising:

a first period for inputting a clock signal of a predetermined period to the scan circuit to sequentially shift a pulse signal;

a second period following the first period, for fixing a level of the clock signal to hold constant levels of the output signals of the scan circuit; and a third period following the second period, for inputting a clock signal of a predetermined period to the scan circuit to sequentially shift the pulse signal, the driving method further comprising the steps of:

inputting, to the second control terminals of the logic gate circuits for a driving, a signal independent from the output signals of the logic gate circuits in the first and third periods and dependent thereon in the second period.

17. A driving method according to claim 9, wherein the liquid crystal display has a blanking period comprising:

a first period for inputting a clock signal of a predetermined period to the scan circuit to sequentially shift a pulse signal;

a second period following the first period, for fixing a level of the clock signal to hold constant levels of the output signals of the scan circuit;

a third period following the second period, for changing the fixed level of the clock signal to effect a first shift of the pulse signal;

a fourth period following the third period, for fixing a level of the clock signal to hold constant levels of the output signals of the scan circuit; and a fifth period following the fourth period, for inputting a clock signal of a predetermined period to the scan circuit to sequentially shift the pulse signal, the driving method further comprising the steps of:

inputting, to the second control terminals of the logic gate circuits for a driving, a signal independent from the output signals of the logic gate circuits in the first, third and fifth periods and dependent thereon in at least one of the second and fourth periods.

18. A driving method according to claim 9, wherein:

in a blanking period, a clock signal to be input to the scan circuit is modulated to a higher frequency than in an image writing period, to transfer a pulse signal; and in the transfer period, an output of the scan circuit causes a signal reflective on outputs of the logic gate circuits to be input for a driving to the second control terminals of the logic gate circuits.

19. A driving method for driving a liquid crystal display including an active matrix array having switching elements thereof arranged at cross points between scan lines and data lines, a vertical drive circuit for driving the scan lines, and a horizontal drive circuit for driving the data lines, the driving method comprising the steps of:

providing in the horizontal drive circuit an N-staged scan circuit for providing N outputs of a pulse signal sequentially shifted by half a period of a clock signal, where N is a positive integer;

providing in the horizontal drive circuit N×M first logic gate circuits having first control terminals of combinations of M first logic gate circuits thereof common connected therebetween, respectively of those combinations, to be connected to N output terminals of the scan circuit, respectively, where M is an integer larger than unity, and second control terminals of combinations of first logic gate circuits at intervals of 2×M−1 thereof common connected therebetween, respectively of these combinations;

providing in the horizontal drive circuit N×M second logic gate circuits having first control terminals thereof connected to output terminals of the first logic gate circuits and second control terminals thereof common connected therebetween; and providing in the horizontal drive circuit N×M data sampling and holding switches having control terminals of combinations of J data sampling and holding switches thereof common connected therebetween, respectively of these combinations, to be connected to output terminals of the second logic gate circuits, respectively, where J is a positive integer, and input terminals of combinations of data sampling and holding switches at intervals of J−1 thereof common connected therebetween, respectively of these combinations.

20. A driving method according to claim 19, further comprising the steps of:

inputting a clock signal having a period of 2×M×T to the scan circuit, where T is a scan line selection interval;

sequentially inputting 2×M different pulse signals A-1, A-2, . . . , A-(2×M) to second control terminals D-1, D-2, . . . , D-(2×M) of the N×M first logic gate circuits, the 2×M pulse signals having a pulse duration between 0 and {(M+1)×T}, a pulse period of 2×M×T and phases sequentially shifted by a period of T; and having outputs of the first logic circuits cause a signal reflective on outputs of the second logic gate circuits to be input for a driving to the second control terminals of the second logic gate circuits.

21. A driving method according to claim 19, further comprising the steps of:

inputting a clock signal having a period of 2×M×T to the scan circuit, where T is a scan line selection interval;

inputting 2×M different pulse signals A-1, A-2, . . . , A-(2×M) in a reverse order to second control terminals D-1, D-2, . . . , D-(2×M) of the N×M first logic gate circuits, the 2×M pulse signals having a pulse duration between 0 and {(M+1)×T}, a pulse period of 2×M×T and phases sequentially shifted by a period of T; and having outputs of the first logic circuits cause a signal reflective on outputs of the second logic gate circuits to be input for a driving to the second control terminals of the second logic gate circuits.

22. A driving method according to claim 19, further comprising having in a vertical blanking period outputs of the first logic gate circuits cause a signal non-reflective on outputs of the second logic gate circuits to be input to the second control terminals of the second logic gate circuits and a signal level representative of a black display input to J input terminals of the sampling and holding switches.

23. A driving method according to claim 19, wherein:

in a horizontal blanking period, a clock signal to be input to the scan circuit is modulated to a higher frequency than in an image writing period, to transfer a pulse signal; and in the transfer period, outputs of the scan circuit cause a signal reflective on outputs of the first logic gate circuits to be input to the second control terminals of the first logic gate circuits, and outputs of the first logic gate circuits cause a signal reflective on outputs of the second logic gate circuits to be input to the second control terminals of the second logic gate circuits and a signal level representative of a black display to be input to J input terminals of the sampling and holding switches, for a driving.

24. A driving method for a liquid crystal display including an active matrix array having switching elements thereof arranged at cross points between scan lines and data lines, a vertical drive circuit for driving the scan lines, and a horizontal drive circuit for driving the data lines, the driving method comprising the steps of:

providing in the horizontal drive circuit an N-staged scan circuit for providing N outputs of a pulse signal sequentially shifted by half a period of a clock signal, where N is a positive integer;

providing in the horizontal drive circuit N×M logic gate circuits having first control terminals of combinations of M logic gate circuits thereof common connected therebetween, respectively of those combinations, to be connected to N output terminals of the scan circuit, respectively, where M is an integer larger than unity, and second control terminals of combinations of logic gate circuits at intervals of 2×M−1 thereof common connected therebetween, respectively of these combinations;

providing in the horizontal drive circuit output buffer circuits for inputting output signals of the logic gate circuits; and providing in the horizontal drive circuit N×M data sampling and holding switches having control terminals of combinations of J data sampling and holding switches thereof common connected therebetween, respectively of these combinations, to be connected to output terminals of the output buffer circuits, respectively, where J is a positive integer, and input terminals of combinations of data sampling and holding switches at intervals of J−1 thereof common connected therebetween, respectively of these combinations.

25. A driving method according to claim 24, wherein in a vertical blanking period, a clock signal of a predetermined period is input to the scan circuit, and outputs of the scan circuit cause a signal reflective on outputs of the logic gate circuits to be input to the second control terminals of the logic gate circuits and a signal level representative of a black display to be input to J input terminals of the data sampling and holding switches, for a driving.

* * * * *